US009001164B2

(12) United States Patent
Ito

(10) Patent No.: US 9,001,164 B2
(45) Date of Patent: Apr. 7, 2015

(54) ELECTRO-OPTICAL DEVICE AND ELECTRONIC DEVICE

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 13/612,180

(22) Filed: Sep. 12, 2012

(65) Prior Publication Data

US 2013/0069996 A1 Mar. 21, 2013

(30) Foreign Application Priority Data

Sep. 16, 2011 (JP) ..... 2011-202805

(51) Int. Cl.

*G09G 5/10* (2006.01)
*G09G 3/36* (2006.01)
*G09G 3/00* (2006.01)

(52) U.S. Cl.

CPC ..... *G09G 3/3614* (2013.01); *G09G 3/002* (2013.01); *G09G 3/003* (2013.01); *G09G 2300/0426* (2013.01); *G09G 2320/0209* (2013.01); *G09G 2320/0247* (2013.01); *G09G 2320/0252* (2013.01)

(58) Field of Classification Search

CPC ..... G02B 27/22; G02B 27/2264
USPC ..... 345/419, 690
See application file for complete search history.

(56) References Cited

U.S. PATENT DOCUMENTS

2001/0043266 A1* 11/2001 Robinson et al. ..... 348/53
2010/0309297 A1* 12/2010 Nakagawa et al. ..... 348/56
2011/0255019 A1* 10/2011 Son ..... 349/15
2011/0292041 A1* 12/2011 Lee et al. ..... 345/419
2012/0062539 A1* 3/2012 Koyama ..... 345/211

FOREIGN PATENT DOCUMENTS

JP 2009-025436 A 2/2009

* cited by examiner

*Primary Examiner* — Viet Pham
(74) *Attorney, Agent, or Firm* — Maschoff Brennan

(57) ABSTRACT

A plurality of pixels are arranged corresponding to interconnection between a plurality of scan lines and a plurality of signal lines. A drive circuit alternately displays a right-eye image and a left-eye image on the plurality of pixels every display period. Specifically, the drive circuit sequentially selects the scan lines and supplies a preparation potential corresponding to given grayscale potential (for example, black grayscale) to each of the pixels corresponding to the scan line in a selection state, during a preparation of each of the display periods, and sequentially selects the scan lines and supplies grayscale potential that is in response to an assigned grayscale of the corresponding pixel to each of the pixels corresponding to the scan line in the selection state, during a drive period that starts before selecting the scan line during the preparation of each of the display periods.

11 Claims, 12 Drawing Sheets

| | U1 | | U2 | |
|---|---|---|---|---|
| | W1 | W2 | W1 | W2 |
| WRITE POLARITY | + | + | − | − |
| 2k-TH LINE | 0 V (Gi[2k−1]) | +5 V (Gi[2k]) | −5 V (Gi[2k]) | −5 V (NON-SELECTION) |
| (2k+1)-TH LINE | 0 V (Gi[2k+1]) | 0 V (NON-SELECTION) | −5 V (Gi[2k]) | 0 V (Gi[2k+1]) |

PRIOR ART

ELECTRO-OPTICAL DEVICE AND ELECTRONIC DEVICE

BACKGROUND

1. Technical Field

The present invention relates to a technology which displays right-eye and left-eye images that are given parallax with respect to each other in order for a viewer to perceive stereoscopy.

2. Related Art

A stereoscopic-viewing method has been proposed which employs a frame sequential method of alternately displaying right-eye and left-eye images in a time-division manner. During the period of time when the display image is changed from the right-eye image to the left-eye image and vice versa, the right-eye and left-eye images are mixedly present, and thus the viewer has difficulty perceiving a definite stereoscopy when visually recognizing the image (crosstalk). To solve this problem, for example, in JP-A-2009-25436, a technology is disclosed which enables the image to be visually unrecognizable to the viewer, with both of right-eye and left-eye shutters of the stereoscopic viewing glasses being closed, during the period of time when the display image is changed from the right-eye image to the left-eye image and vice versa (that is, during the period of time when the right-eye and left-eye images are mixed together).

As shown FIG. 15, a display period PR of the right-eye image and a display period PL of the left-eye image are set in an alternating way. Each of the display periods P (PR, PL) is divided into a unit period U1 and a unit period U2. During the unit period U1 of the display period PR, the display image is changed from the left-eye image to the right-eye image, and during the unit period U2 immediately following the unit period U1, the right-eye image is displayed. During the unit period U1 of the display period PL, the display image is changed from the right-eye image to the left-eye image, and during the unit period U2 immediately following the unit period U1, the left-eye image is displayed. During the unit period U1 of each of the display periods P, both of the right-eye and left-eye shutters are controlled to be in a closed state. Therefore, concurrent presence of the right-eye and left-eye images is imperceptible to the viewer.

However, in the technology disclosed in JP-A-2009-25436, the period during which the viewer can actually visually recognize the image is limited to the unit period U2 (that is, about half a minute) of each of the display periods P. Therefore, it is difficult to obtain sufficient brightness of the display image.

SUMMARY

An advantage of some aspects of the invention is to improve brightness of a display image, controlling concurrent presence of right-eye and left-eye images to be imperceptible to a viewer.

According to an aspect of the invention, an electro-optical device is provided which is capable of every display period, includes a plurality of pixels arranged corresponding to interconnections between a plurality of scan lines and a plurality of signal lines, and a drive circuit sequentially selecting the scan lines during a preparation period of each of the display periods and supplying a preparation potential to each of the pixels corresponding to the scan line in a selection state, and sequentially selecting the scan line during a drive period starting before selecting the last scan line during the preparation period of each of the display periods and supplying grayscale potential according to an assigned grayscale of the corresponding pixel to each of the pixels corresponding to the scan line in the selection state. The given grayscale is selected independently of the content of a display image. Typically, a black grayscale (the lowest grayscale) is suitably selected as the given grayscale.

In this configuration, since the display grayscale of each of the pixels is set to the given grayscale during the preparation period of each of the display periods, concurrent presence of the right-eye and left-eye images (crosstalk) may be prevented. Furthermore, since the supplying of the grayscale potential to each of the pixel starts during the drive period before finishing selecting the plurality of scan lines during the preparation period starts, the time length of the drive period during the display period may be greater, compared with a configuration in which the drive period starts after finishing selecting the plurality of scan lines during the preparation period. Therefore, since concurrent presence of the right-eye and left-eye images is prevented from being perceptible to a viewer, brightness of the display image may be improved.

It is preferable that the drive circuit sequentially select the scan lines several at a time during a first unit period among a plurality of unit periods of the drive period of each of the display periods and supply the grayscale potential according to the assigned grayscale of each of the pixels corresponding to any of the plurality of scan lines in the selection state to each of the pixels corresponding to the plurality of scan lines in the selection state. In this configuration, the scan lines are selected several scan lines at a time during the first unit period of the drive period and the grayscale potential is supplied to each of the pixels. Therefore, for example, the length of time it takes the display grayscale of each of the pixels to be changed from the immediately preceding given grayscale to the assigned grayscale may be shortened, compared with the configuration in which the scan lines are selected one after another during the first unit period of the drive period and the grayscale potential is supplied to each of the pixels.

It is preferable that the plurality of scan lines include first scan lines and second scan lines which are alternately arranged, and the drive circuit capable of performing a first drive of sequentially selecting first sets of scan lines that are determined by dividing the plurality of scan lines by two adjacent scan lines at a time and supplying the grayscale potential according to the assigned grayscale of each of the pixels corresponding to the first scan line among the first sets of the scan lines in the selection state to each of signal lines during a first write period, and sequentially selecting each of the second scan lines and supplying the grayscale potential that is in response to the assigned grayscale of each of the pixels corresponding to the second scan lines in the selection state to each of the signal lines during a second write period after the end of the first write period, and capable of performing a second drive of sequentially selecting second sets of scan lines that are determined by dividing the plurality of scan lines by two adjacent scan lines at a time in a different combination from the combination used when determining the first sets and supplying the grayscale potential that is in response to the assigned grayscale of each of the pixels corresponding to the second scan line among the second sets of scanning lines in the selection state to each signal line during the first write period, and sequentially selecting each of the first scan lines and supplying the grayscale potential that is in response to the assigned grayscale of each of the pixels corresponding to the first scan lines in the selection state to each of the signal lines during the second write period, perform the first drive during a first unit period of the drive period of the display period of the right-eye image and perform the second drive during a second unit period after the first unit period ends during the corresponding drive period, and perform the second drive during the first unit period of the drive period of the display period of the left-eye image and performs the first drive during the second unit period of the corresponding drive period. In this configuration, since the scan lines are sequentially selected two scan lines at a time and the grayscale potential is supplied to each of the pixels during the first write period of the first unit period of the drive period of each of the display periods, for example, the period of time when it takes the given grayscale, set to each pixel PIX during the immediately preceding preparation period, to be changed to the assigned grayscale of the display image is shorted, compared with the configuration in which the scan lines is selected one after another during the first unit period. Therefore, brightness of the display image may be improved. Furthermore, since the relationship between the first unit period/the second unit period and the first drive/the second drive is reversed during the display period of the right-eye image and during the display period of the left-eye image, polarity bias in the applied voltage to the pixel is offset during the display period of the right-eye image and during the display period of the left-eye image. Therefore, characteristic deterioration in the pixel, resulting from application of a DC component, may be controlled.

It is preferable that the drive circuit set the polarity of the applied voltage to each of the pixels to a first polarity during the first and second write periods of the first unit period of the drive period of each of the display periods, and set the polarity of the applied voltage to each of the pixels to a second polarity, which is the reverse of the first polarity, during the first and second write periods of the second unit period of the drive period of each of the display periods. In this configuration, since the polarity of the applied voltage to the pixel is reversed every unit period, a polarity reverse cycle is, for example, shortened, compared with the configuration in which the polarity of the applied voltage is reversed every display period. Therefore, there is an advantage in that fluctuation in the display grayscale (flickering), resulting from difference in the polarity of the applied voltage is difficult for the viewer to perceive.

It is preferable that the drive circuit perform the first drive during the first unit period of the drive period of the display period of the right-eye image, and perform the second drive during the second unit period of the corresponding drive period, and perform the second drive during the first unit period of the drive period of the display period of the left-eye image and perform the first drive during the second unit period of the corresponding drive period, during the first control period among a plurality of control periods each of which includes the display period of the right-eye image and the display period of the left-eye image that appear in an alternating way, and perform the second drive during the first unit period of the drive period of the display period of the right-eye image and perform the first drive during the second unit period of the corresponding drive unit and perform the first drive during the first unit period of the drive period of the display period of the left-eye image and perform the second drive during the second unit period of the corresponding drive period, during the second control period different from—the first control period, among the plurality of control periods. In this configuration, since the relationship between the first unit period/the second unit period and the first drive/the second drive is reversed during the first control period and during the second control period, there is, as mentioned above, a considerable effect of controlling the characteristic deterioration (residual of a DC component) in the pixel, resulting from the polarity bias in the applied voltage to the pixel.

In a case where the number of the scan lines from which the first set and the second set are determined is defined as Q, (Q is a positive integer equal to or greater than 2), the drive circuit is preferably represented as an element which performs a first drive of sequentially selecting the first sets of scan lines that are determined by dividing the plurality of scan lines Q scan lines adjacent to each other at a time and supplying the grayscale potential that is in response to the assigned grayscale of each of the pixels corresponding to the first scan line in the first set in the selection state to each of the signal lines during the first write period and supplying the grayscale potential that is in response to the assigned grayscale of each of the pixels corresponding to the q-th scan line in each of the first sets to each of the signal lines during the q-th write period (q=2 to Q) after the first write period ends, and a second drive of sequentially selecting the second sets of scan lines that are determined by dividing the plurality of scan lines Q scan lines adjacent to each other at a time in a different combination from the combination used when determining the first sets and supplying the grayscale potential that is in response to the assigned grayscale of each of the pixels corresponding to the first scan line in the second set in the selection state to each signal line during the first write period, and supplying the grayscale potential that is in response to the assigned grayscale of each of the pixels corresponding to the q-th scan line in each of the second sets to each of the signal lines, during the q-th write period.

It is preferable that the plurality of scan lines include first scan lines and second scan lines which are alternately arranged, and the drive circuit sequentially select the first sets of scan lines that are determined by dividing the plurality of scan lines by two adjacent scan lines at a time and supply the grayscale potential that is in response to the assigned grayscale of each of the pixels corresponding to the first scan line in the first sets in the selection state to each of the signal lines, during one of the first unit period and the second unit period of the drive period of each of the display periods, and sequentially select the second sets of scan lines that are determined by dividing the plurality of scan lines by two adjacent scan lines at a time in a different combination from the combination used when determining the first sets and supply the grayscale potential that is in response to the assigned grayscale of each of the pixels corresponding to the second scan lines in the second sets in the selection state to each of the signal lines, during the other of the first unit period and the second unit period. A specific example of the embodiment mentioned above will be described below as, for example, a fourth embodiment.

It is preferable that the drive circuit sequentially select the first sets of scan lines and supply the grayscale potential to each of the pixels during the first unit period of each of the display periods of the right-eye image, and sequentially select the second sets of scan lines and supply the grayscale potential to each of the pixels during the second unit period of the corresponding display period, and sequentially select the second sets of scan lines and supply the grayscale potential to each of the pixels during the first unit period of each of the display periods of the left-eye image, and sequentially select the first sets of scan lines and supply the grayscale potential to each of the pixels during the second unit period of the corresponding display period.

It is preferable that the drive circuit select the plurality of scan lines several scan lines at a time during the preparation period, in the embodiments mentioned above. In this configuration, since the plurality of scan lines are selected by two or more and the potential that is in response to the preparation potential is supplied to each of the pixels, the time length of the preparation period is shortened, compared with the configuration in which the plurality of scan lines are selected one after another during the preparation period. Therefore, there is a considerable effect of improving brightness of the display image.

It is preferable that the electro-optical device further includes stereoscopic viewing glasses that display the right-eye and left-eye images that are able to be viewed stereoscopically, and that include a right-eye shutter and a left-eye shutter, and a glasses-control circuit controlling both of the right-eye and left-eye shutters to be in a closed state during the period including at least a section of the preparation period of each of the display periods, controlling the right-eye shutter to be in an open state and controlling the left-eye shutter to be in the closed state during a period including at least a section of the drive period of the display period of the right-eye image, and controlling the left-eye shutter to be in an open state and controlling the right-eye shutter to be in the closed state during a period including at least a section of the drive period of the display period of the left-eye image.

The electro-optical device according to the aspect of the invention is used as a display body in an electronic device. For example, the stereoscopic-view display device, which includes the electro-optical device relating to each of the embodiments described above and the stereoscopic viewing glasses controlled by the glasses-control circuit, is referred to as an electronic device to which the aspect of the invention is applied.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
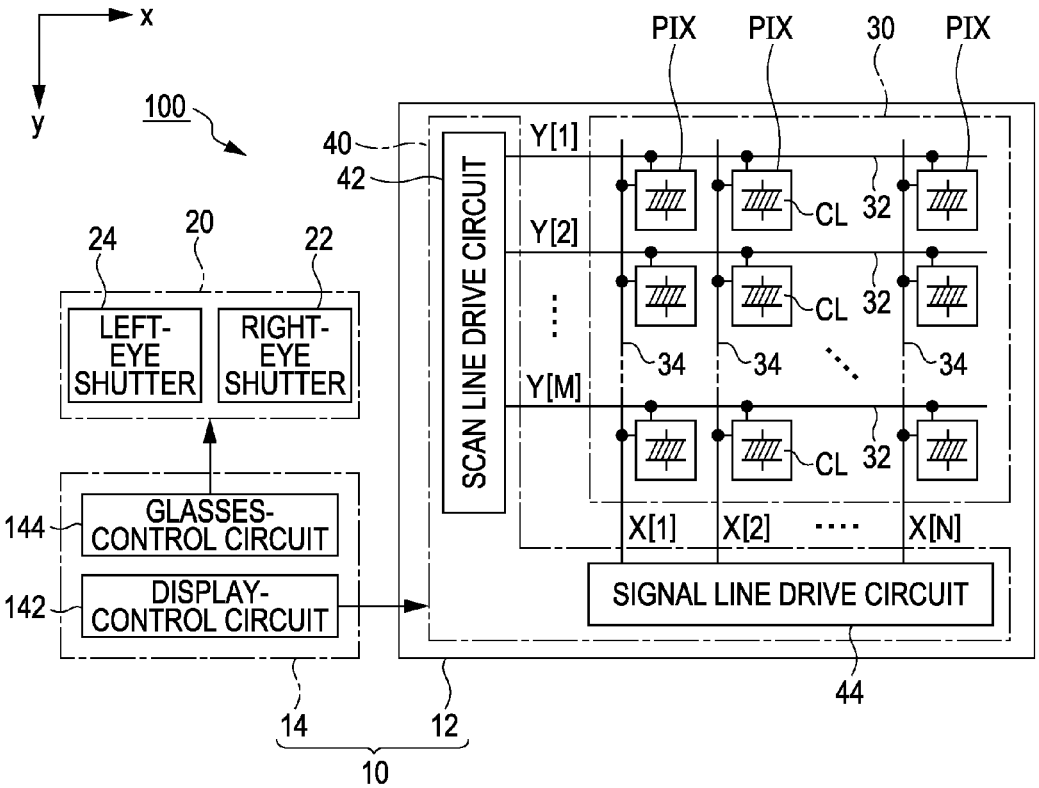
FIG. 1 is a block diagram illustrating a stereoscopic display according to a first embodiment of the aspect of the invention.

FIG. 1 is a block diagram illustrating a stereoscopic display 100 according to the first embodiment of the aspect of the invention. The stereoscopic display 100 is an electronic device that displays a stereoscopic image, which enables a viewer to perceive stereoscopy, by an active shutter method, and includes an electro-optical device 10 and stereoscopic viewing glasses 20. The electro-optical device 10 alternately displays right-eye and left-eye images GR and GL which are given parallax with respect to each other, in a time division manner. The right-eye and left-eye images GR and GL will be comprehensively described below, along with an image Gi (i=R, L).

The stereoscopic viewing glasses 20 are a spectacles-type aid which the viewer wears when visually recognizing the stereoscopic image which the electro-optical device 10 displays, and includes a right-eye shutter 22, positioned before the viewer's right eye and a left-eye shutter 24, positioned before the viewer's right eye. Each of the right-eye and left-eye shutters 22 and 24 is controlled to maintain an open state (a penetration state) in which illumination light is permitted to penetrate, or a closed state (a light-blocking state) in which the illumination light is prevented from penetrating. For example, a liquid crystal shutter, which changes from the open state to the closed state and vice versa, by changing the orientation direction of the liquid crystal depending on applied voltage, may be used as the right-eye and left-eye shutters 22 and 24.

The electro-optical device 10 in FIG. 1 includes an electro-optical panel 12 and a control circuit 14. The electro-optical panel 12 includes a pixel unit 30 in which a plurality of pixels PIX (a pixel circuit) is arranged, and a drive circuit 40 driving each of the pixels PIX. In the pixel unit 30, the M scan lines 32 are formed to extend in the x direction, and the N signal lines 34 are formed to extend in the y direction intersecting the x direction (M and N are positive integers). The plurality of pixels PIX in the pixel section 30 are arranged in a matrix with M columns and N rows corresponding to interconnections between the scan lines 32 and the signal lines 34.

Figure 2:
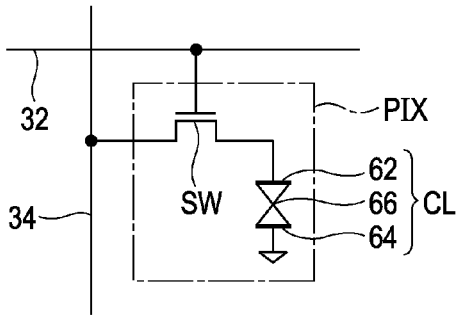
FIG. 2 is a circuit diagram illustrating a pixel circuit.

FIG. 2 is a circuit diagram of each of the pixels PIX. As shown in FIG. 2, each of the pixels PIX includes a liquid crystal cell CL and a selection switch SW. The liquid crystal cell CL is an electro-optical element that is configured by pixel and common electrodes 62 and 64 which are opposite to each other, and a liquid crystal 66 between the pixel and common electrodes 62 and 64. Transmission (display gray-scale) of the liquid crystal 66 changes according to applied voltage between the pixel and common electrodes 62 and 64. The selection switch SW is configured by an N-channel thin film transistor whose gate is connected to the scan line 32, and is interposed between the liquid crystal cell CL and the signal line 34 to control electric connection (conduction/insulation) between the liquid crystal cell CL and the signal line 34. Furthermore, the configuration may be employed in which an additional capacitor is connected in parallel to the liquid crystal cell CL.

The control circuit 14 in FIG. 1 includes a display-control circuit 142 controlling the electro-optical panel 12, and a glasses-control circuit 144 controlling the stereoscopic viewing glasses 20. Furthermore, a mounted configuration may be employed in which the display-control circuit 142 and the glasses-control circuit 144 is built into a single integrated circuit, or a distributed configuration may be employed in which the display-control circuit 142 and the glasses-control circuit 144 is built into separate integrated circuits, respectively. The display-control circuit 142 controls the drive circuit 40, to display the right-eye image GR and the left-eye image GL, given parallax with respect to each other, on the pixel unit 30 in an alternating way, with time division.

The drive circuit 40 is a circuit supplying to each of the pixels PIX a drive signal X [n] controlling the display grayscale of each of the pixels PIX, and includes a scan line drive circuit 42 and a signal line drive circuit 44. The scan line drive circuit 42 sequentially selects each of the scan lines 32 by applying a scan signal Y[1] to Y[M] corresponding to each of the scan lines 32. The scan signal Y[m] (m=1 to M) is set to given selection potential (that is, the scan line 32 in the m-th row is selected), and thus the selection switches SW in each of the pixels PIX in the m-th row change to an on state at the same time.

The signal line drive circuit 44 is synchronized with selection of the scan line 32 by the scan line drive circuit 42, and thus supplies the drive signal X[1] to X[N] to each of the N signal lines 34. Each of the pixels PIX (the liquid crystal cell CL) displays a grayscale that is in response to potential of the drive signal X[n] (n=1 to N) supplied to the signal line 34 at the time of selecting the scan line 32 (at the time of the selection switch SW being controlled to be in the on state).

Figure 3:
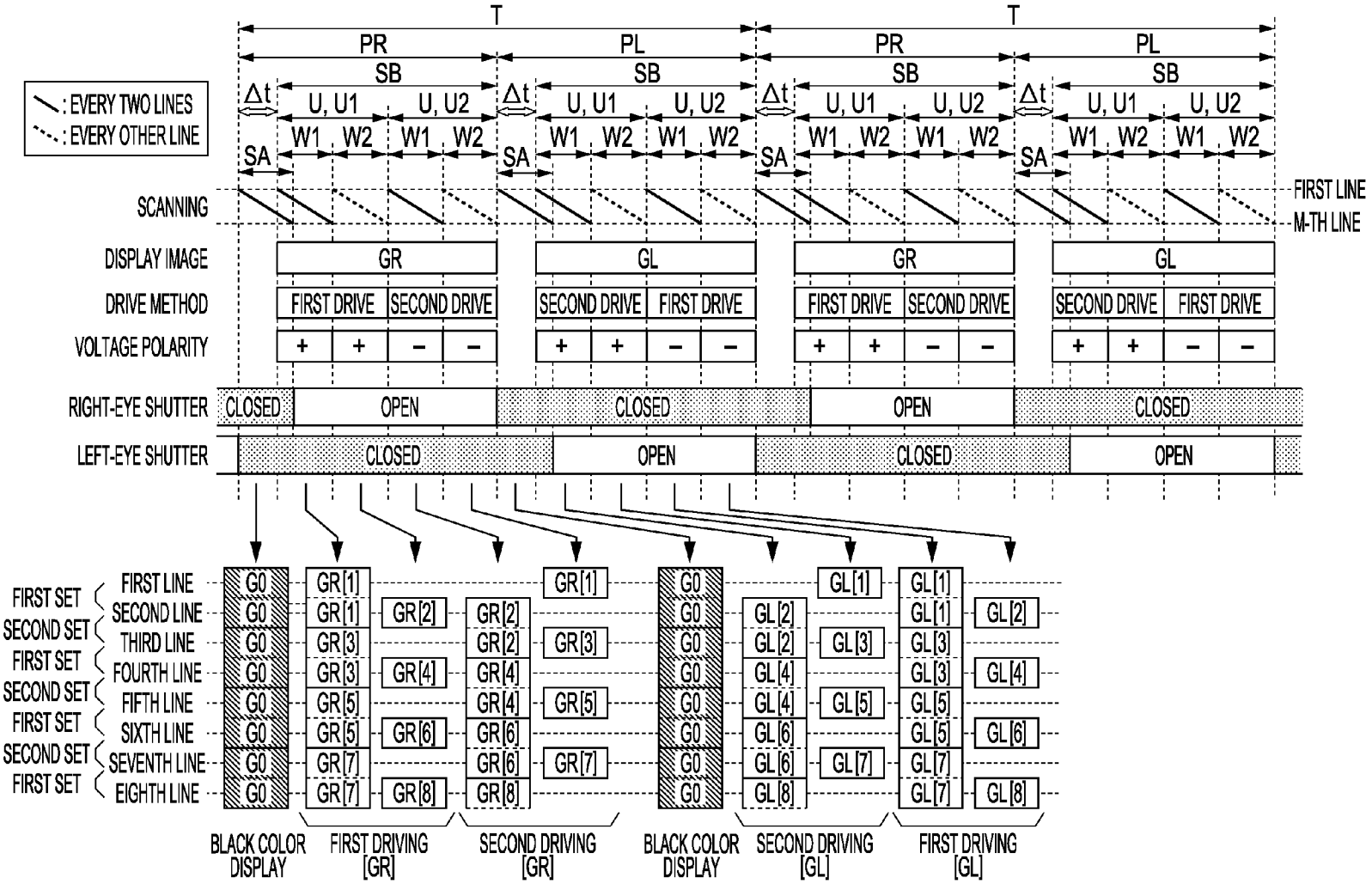
FIG. 3 is an explanatory view illustrating operation of a stereoscopic view device.

FIG. 3 is an explanatory view illustrating operation of the electro-optical device 10. As shown in FIG. 3, an operation period of the electro-optical device 10 is divided into a plurality of control periods T. Each of the control periods T is divided into two display periods Pi (a right-eye display period PR and a left-eye display period PL), each with a given length. During the right-eye display period PR, the right-eye image GR is displayed on the pixel unit 30, and during the left-eye display period PL, the left-eye image GL is displayed on the pixel unit 30. The right-eye display period PR and the left-eye display period PL are alternately arranged, along the time axis. That is, one control period T is made up of the left-eye display period PL and the right-eye display period PR that occur in an alternating way. A time length of the control period T is set to, for example, about 1/60 second corresponding to a frame rate of 60 Hz, and a time length of each of the display periods Pi is set to about 1/120 second (about 8 milliseconds).

As shown in FIG. 3, each of the display periods Pi (PR, PL) is configured by a preparation period SA and a drive period SB. The drive period SB is a period during which to supply a grayscale potential according to a grayscale (hereinafter referred to as "an assigned grayscale") that the image signal supplied from an outside circuit assigns to each of the pixels PIX, to each of the pixels PIX. On the other hand, the preparation period SA is a period during which to supply a potential (hereinafter referred to as "preparation potential") that is in response to a given grayscale G0 to each of the pixels PIX. The given grayscale G0 is a grayscale that is set independently of the assigned grayscale of each of the pixels PIX. For example, black (the lowest grayscale) is suitably employed as the given grayscale G0.

Figure 4:
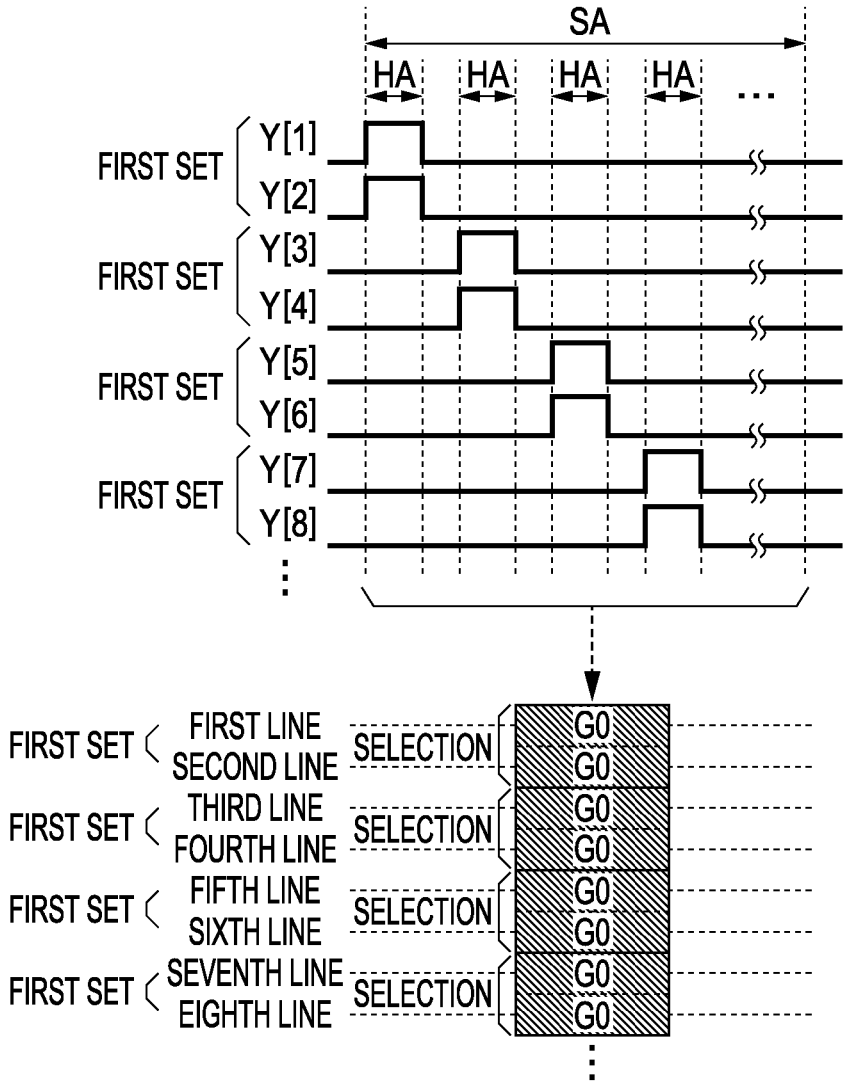
FIG. 4 is an explanatory view illustrating operation of a drive circuit during a preparation period.

FIG. 4 is an explanatory view illustrating operation of the drive circuit 40 during the preparation period SA of each of the display periods Pi (PR, PL). As shown in FIG. 4, during the preparation period SA of each of the display periods Pi, the scan line drive circuit 42 sequentially selects each of a plurality of sets of scan lines, each set of scan lines (hereinafter referred to as "the first set") being determined by grouping the M scan lines 32 by two adjacent scan lines at a time, every selection period HA. The first set is configured by one scan line 32 in the even-numbered row (in the 2k-th row) and another scan line 32 adjacent to the one scan line 32 in the odd-numbered row (in the (2k−1)-th row), in the negative y direction. The scan line drive circuit 42 sets the scan signal Y[2k−1] and the scan signal Y[2k] as the selection potential during one selection period HA of the preparation period SA, and thus selects two of the scan lines 32 in the first set at the same time. For example, during the first selection period HA of the preparation period SA, two of the scan lines 32 in the first and second rows are selected at the same time, and during the second selection period HA of the preparation period SA, two of the scan lines 32 in the third and fourth rows are selected at the same time.

The signal line drive circuit 44 supplies to each of the signal lines 34 the drive signal X [n] of the preparation potential that is in response to the given grayscale G0, during each of the selection periods HA of the preparation period SA of each of the display periods Pi (PR, PL). Therefore, as shown in FIG. 4, during each of the selection periods HA of the preparation period SA, the preparation potential, selected independently of the image Gi, is supplied to each of the pixels PIX, and thus each of the pixels PIX is controlled to the level of the given grayscale G0 (black grayscale).

On the other hand, the drive period SB, as shown in FIG. 3, is divided into two unit periods U (U1, U2), each with an equal time length. The unit period U2 follows the unit period U1. Each of the unit periods U (U1, U2) includes first and second write periods W1 and W2. The second write period W2 follows the first write period W1.

Figure 5:
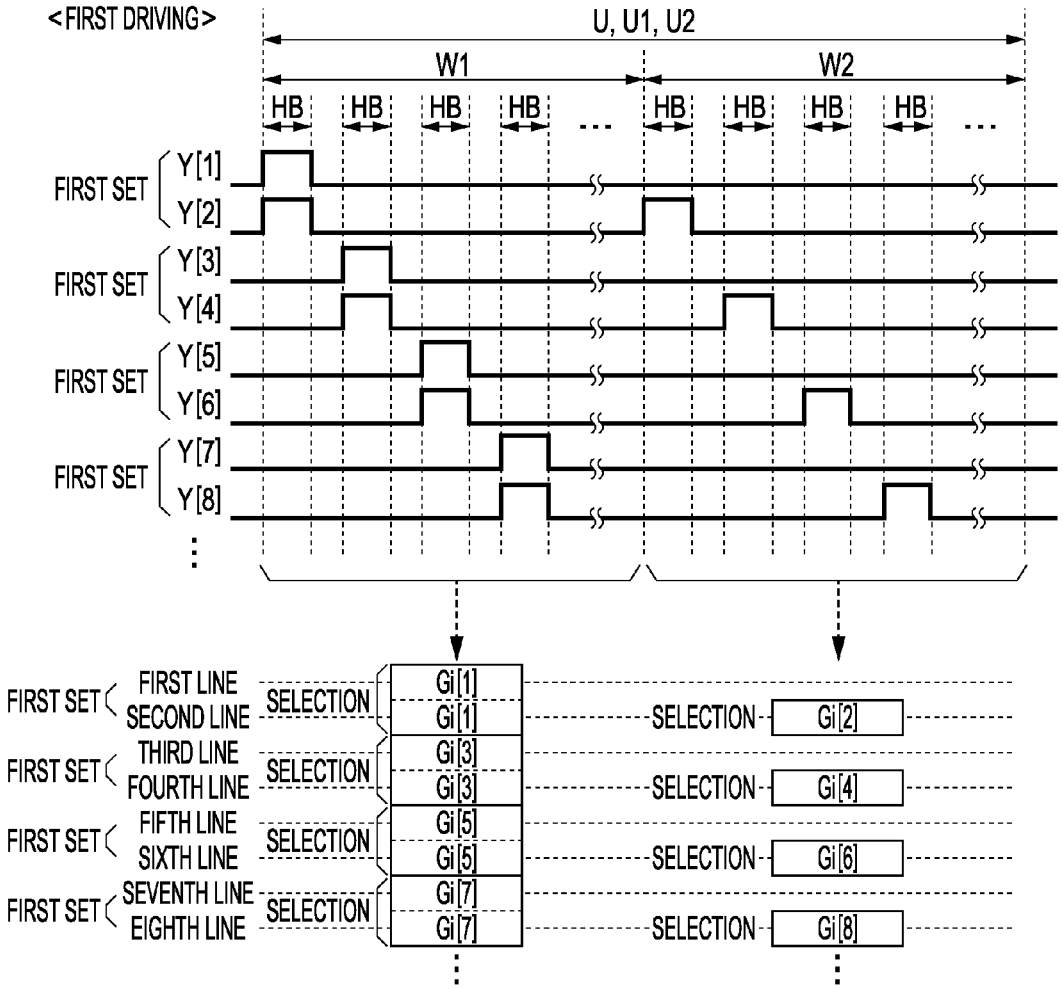
FIG. 5 is an explanatory view illustrating a first drive.
Figure 6:
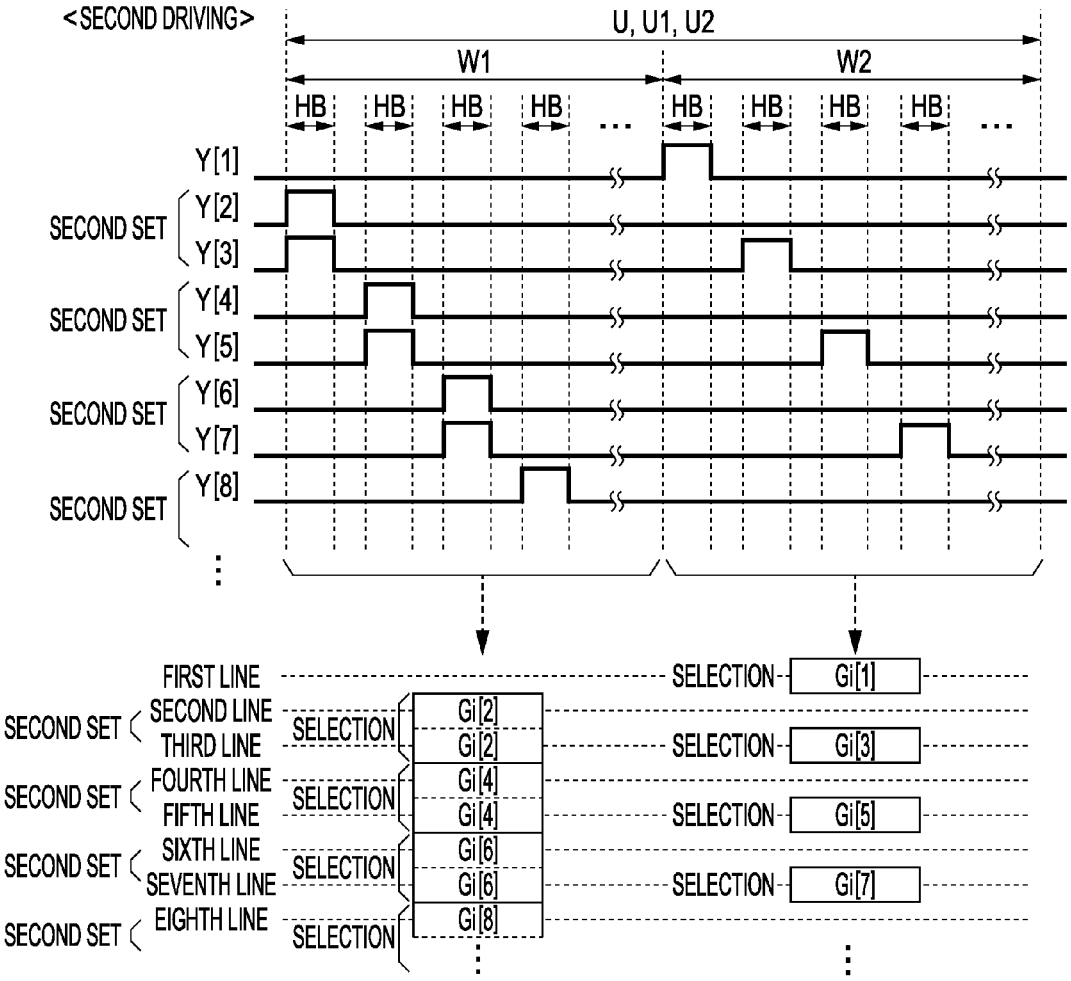
FIG. 6 is an explanatory view illustrating a second drive.

The drive circuit 40 may selectively perform a first drive in FIG. 5 and a second drive in FIG. 6 every unit period U of the drive period SB of each of the display periods Pi. The first drive, as shown in FIG. 5, is a driving method to drive each of the plurality of first sets, each first set being determined by grouping the M scan lines 32 by two adjacent scan lines at a time. On the other hand, the second drive, as shown in FIG. 6, is a driving method to drive each of the plurality of sets of scan lines, each set of scan lines (hereinafter referred to as "the second set") being determined by grouping the M scan lines 32 by two adjacent scan lines at a time, in a different combination from the combination used when determining the first set. The second set is configured by one scan line 32 in the even-numbered row (in the 2k-th row) and another scan line 32 adjacent to the one scan line 32 in the adjacent odd-numbered row (in the (2k+1)-th row) in the positive y direction. That is, the first set and the second set are at a distance of one scan line 32 only from each other, in the y direction. The first drive and the second drive will be separately described below.

First Drive

The first drive is the driving method to sequentially select the first sets and supply to each of the signal lines 34 the grayscale potential that is in response to the assigned grayscale of each of the pixels PIX which corresponds to the scan line 32 in the odd-numbered row (the (2k−1)-th row) among the first sets in the selection state, during the first write period W1 of the unit period U, and sequentially select the scan line 32 in the even-numbered row (the 2k-th row) and supply to each of the signal lines 34 the grayscale potential that is in response to the assigned grayscale of each of the pixels PIX which corresponds to the scan line 32 in the selection state during the second write period W2 of the unit period U. Operation of the scan line drive circuit 42 and operation of the signal line drive circuit 44 at the time of performing the first drive will be described below.

As shown in FIG. 5, the scan line drive circuit 42 sequentially selects each of the first sets every selection period HB of the first W1. That is, during the k-th selection period HB of the first write period W1, the scan line drive circuit 42 sets to the selection potential the scan signal Y[2k−1] and the scan signal Y[2k], and selects two of the scan lines 32 in the first set in the (2k−1)-th row and the 2k-th row at the same time. For example, during the first selection period HB of the first write period W1, two of the scan lines 32 in the first and second rows are selected at the same time, and during the second selection period HB, two of the scan lines 32 in the third and fourth rows are selected at the same time.

During the first write period W1 of each of the unit periods U of the display period Pi (PR,PL), during the selection period HB during which the two of the scan lines 32 in the first set in the (2k−1)-th row and in the 2k-th row are selected, the signal line drive circuit 44 supplies to each of the signal lines 34 the drive signal X[n] of the grayscale potential that is in response to the assigned grayscale Gi[2k−1] of each of the pixels PIX in the (2k−1)-th row in the image Gi. For example, during the first selection period HB of the first write period W1 of the right-eye display period PR, the drive signal X[n] of the grayscale potential that is in response to the assigned grayscale GR[1] of each of the pixels PIX in the first low in the right-eye image GR, is supplied to each of the signal lines 34, and during the second selection period HB, the drive signal X[n] of the grayscale potential that is in response to the assigned grayscale GR[3] of each of the pixels PIX in the third row in the right-eye image GR, is supplied to each of the signal lines 34.

Therefore, during the k-th selection period HB of the first write period W1, as shown in FIG. 5, the grayscale potential that is in response to the assigned grayscale Gi[2k−1] in the (2k−1)-th row in the image Gi is supplied to each of the pixels PIX both in the (2k−1)-th row and in the 2k-th row is supplied to each of the pixels PIX both in the (2k−1)-th row and the 2k-th row. As a result of this operation, at the time when the first write period W1 ends, the image Gi, of which the resolution in the y direction is reduced in half, is displayed on the pixel unit 30.

On the other hand, during the second write period W2, the scan line drive circuit 42, as shown in FIG. 5, sequentially selects each of the scan lines 32 in the even-numbered row every selection period HB. That is, the M scan lines 32 are selected at an interval of one scan line 32. Specifically, the scan line drive circuit 42, as shown in FIG. 5, sets the scan signal Y[2k] to the selection potential and thus selects one scan line 32 in the 2k-th row, during the k-th selection period HB of the second write period W2. For example, the scan line 32 in the second row is selected during the first selection period HB of the second write period W2, and the scan line 32 in the fourth row is selected during the second selection period HB. The scan lines 32 in the odd-numbered row are not selected during the second write period W2.

During the second write period W2, during the selection period HB during which one scan line 32 in the 2k-th row is selected, the signal line drive circuit 44 supplies to each of the signal lines 34 the drive signal X[n] of the grayscale potential that is in response to the assigned grayscale Gi[2k] of each of the pixels PIX in the 2k-th row in the image Gi. For example, as shown in FIG. 5, during the first selection period HB of the second write period W2 of the right-eye display period PR, the drive signal X[n] of the grayscale potential that is in response to the assigned grayscale GR[2] of each of the pixels PIX in the second row in the right-eye image GR is supplied to each of the signal lines 34, and during the second selection period HB, the drive signal X[n] of the grayscale potential that is in response to the right-eye image GR[4] of each of the pixels PIX in the fourth row in the right-eye image GR is supplied to each of the signal lines 34.

Therefore, during the k-th selection period HB of the second write period W2, as shown in FIG. 5, the drive signal X[n] of the grayscale potential that is in response to the assigned grayscale Gi[2k] in the 2k-th row in the image Gi is supplied to each of the pixels PIX in the 2k-th row. On the other hand, in each of the pixels PIX in the odd-numbered row, the applied voltage to the liquid crystal cell CL is maintained at the setting voltage that is applied during the immediately preceding first write period W1. As a result of this operation, the image Gi, of which the resolution in the y direction is reduced in half at the time when the first write period W1 ends, is replaced with the image Gi, of which the resolution is a given resolution (M rows×N columns) at the time when the second write period W2 ends.

Second Drive

The second drive is the driving method to sequentially select the second sets and supply to each of the signal lines 34 the grayscale potential that is in response to the assigned grayscale of each of the pixels PIX which corresponds to the scan line 32 in the even-numbered row (the 2k-th row) among the second sets in the selection state during the first write period W1 of the unit period U, and sequentially select the scan lines 32 in the odd-numbered row (the (2k+1)-th row) and supply to each of the signal lines 34 the grayscale potential that is in response to the assigned grayscale of each of the pixels PIX which corresponds to the scan line 32 in the selection state during the second write period W2 of the unit period U. Operation of the scan line drive circuit 42 and operation of the signal line drive circuit 44 at the time of performing the second drive will be described below.

As shown in FIG. 6, the scan line drive circuit 42 sequentially selects each of the second sets every selection period HB of the first write period W1. That is, the scan line drive circuit 42 sets the scan signal Y[2k] and the scan signal Y[2k+1] to the selection potential, and thus selects two of the scan lines 32 in the second set in the 2k-th row and in the (2k+1)-th row at the same time during the k-th selection period HB of the first write period W1. For example, during the first selection period HB of the first write period W1, two of the scan lines 32 in the second and third rows are selected at the same time, and during the second selection period HB, two of the scan lines 32 in the fourth and fifth rows are selected at the same time.

During the first write period W1 of each of the unit periods U of the display period Pi (PR,PL), during the selection period HB during which two of the scan lines 32 in the second set in the 2k-th row and in the (2k+1)-th row are selected, the signal line drive circuit 44 supplies to each of the signal lines 34 the drive signal X[n] of the grayscale potential that is in response to the assigned grayscale Gi[2k] of each of the pixels PIX in the 2k-th row in the image Gi. Therefore, during the k-th selection period HB of the first write period W1, as shown in FIG. 6, the grayscale potential that is in response to the assigned grayscale Gi[2k] in the 2k-th row in the image Gi is supplied to each of the pixels PIX both in the 2k-th row and in the (2k+1)-th row.

For example, during the first selection period HB of the first write period W1 of the right-eye display period PR, the grayscale potential that is in response to the assigned grayscale GR[2] of each of the pixels PIX in the second low in the right-eye image GR, is supplied to each of the pixels PIX in the second and third rows, and during the second selection period HB, the grayscale potential that is in response to the assigned grayscale GR[4] of each of the pixels PIX in the fourth row in the right-eye image GR, is supplied to each of the pixels PIX in the fourth and fifth rows. As a result of this operation, at the time when the first write period W1 ends, the image Gi, of which resolution in the y direction is reduced in half, is displayed on the pixel unit 30.

On the other hand, during the second write period W2, the scan line drive circuit 42, as shown in FIG. 6, sequentially selects each of the scan lines 32 in the odd-numbered row every selection period HB. Specifically, the scan line drive circuit 42, as shown in FIG. 6, sets the scan signal Y[2k−1] to the selection potential and thus selects one scan line 32 in the (2k−1)-th row during the k-th selection period HB of the second write period W2, For example, the scan line 32 in the first row is selected during the first selection period HB of the second write period W2, and the scan line 32 in the third row is selected during the second selection period HB. The scan lines 32 in the even-numbered row are not selected during the second write period W2.

During the second write period W2, during the selection period HB during which one scan line 32 in the (2k−1)-th row is selected, the signal line drive circuit 44 supplies to each of the signal lines 34 the drive signal X[n] of the grayscale potential that is in response to the assigned grayscale Gi[2k−1] of each of the pixels PIX in the (2k−1)-th row in the image Gi. Therefore, during the k-th selection period HB of the second write period W2, as shown in FIG. 6, the grayscale potential that is in response to the assigned grayscale Gi[2k−1] in the (2k−1)-th row in the image Gi is supplied to each of the pixels PIX in the (2k−1)-th row. For example, during the first selection period HB of the second write period W2 of the right-eye display period PR, the grayscale potential that is in response to the assigned grayscale GR[1] of each of the pixels PIX in the first low in the right-eye image GR, is supplied to each of the pixels PIX in the first row, and during the second selection period HB, the grayscale potential that is in response to the assigned grayscale GR[3] of each of the pixels PIX in the third row in the right-eye image GR, is supplied to each of the pixels PIX in the third row. As a result of this operation, the image Gi, of which the resolution in the y direction is reduced in half at the time when the first write period W1 ends, is replaced with the image Gi, of which the resolution is a given resolution (M rows×N columns) at the time when the second write period W2 ends.

The first drive and the second drive are described above. As shown in FIG. 3, the drive circuit 40 reverses a combination of the first drive/the second drive and the unit period U1/the unit period U2, during the right-eye display period PR and during left-eye display period PL. That is, the drive circuit 40 performs the first drive during the unit period U1 of the drive period SB of right-eye display period PR and performs the second drive during the unit period U2 of that drive period SB, and performs the second drive during the unit period U1 of the drive period SB of the left-eye display period PL and performs the first drive during the unit period U2 of that drive period SB.

Furthermore, the drive circuit 40 sequentially reverses a polarity of the grayscale potential to the given reference potential every unit period U, to periodically reverse a polarity of the applied voltage to the liquid crystal cell CL of each of the pixels PIX. Specifically, the polarity of the applied voltage to the liquid crystal cell CL, as shown in FIG. 3, is set to a positive polarity (+) during the unit period U1 of each of the display periods Pi, and is set to a negative polarity (−) during the unit period U2 of each of the display periods Pi.

In the first embodiment as described above, since the polarity of the applied voltage to the liquid crystal cell CL is reversed every unit period U, it may be restated that the relationship between the polarity of the applied voltage to the liquid crystal cell CL and the first drive/the second drive is reversed during the right-eye display period PR and during left-eye display period PL. That is, during the right-eye display period PR, when the applied voltage to the liquid crystal cell CL is the positive polarity (the unit period U1), the first drive is performed, and at the time, when the applied voltage to the liquid crystal cell CL is the negative polarity (the unit period U2), the second drive is performed. During the left-eye display period PL, when the applied voltage to the liquid crystal cell CL is the positive polarity (the unit period U1), the second drive is performed, and at the time, when the applied voltage to the liquid crystal cell CL is the negative polarity (the unit period U2), the first drive is performed.

In FIG. 3, the time-based transition of the scan lines 32 (in the first row to the M-th row), which is selected during the display period Pi, is conveniently indicated in a straight line. In FIG. 3, selection of the scan lines 32 in two's (selection of the scan lines 32 during the preparation period SA and first write period W1) is indicated by solid line, and selection of the scan line 32 at an interval of one scan line 32 (selection of the scan line 32 during the second write period W2) is indicated by a broken line.

As is apparent from FIG. 3, the drive period SB starts from the time when a time length Δt only elapses from the starting point of the preparation period SA. The time length Δt is a length of time (the difference in time between the preparation period SA and the drive period SB) from the time when the selection of the scan lines 32 in the M-th row during the selection period HA of the preparation period SA starts to the time when the selection of the scan lines 32 in the m-th row during the selection period HB of the drive period SB starts. The time length Δt is set to a short time period, compared with the time length of the preparation period SA. Therefore, the rear section of the preparation period SA and the front section of the drive period SB overlap each other along the time axis. That is, before finishing the selection of the M scan lines 32 during the preparation period SA (that is, before closing the selection of the scan lines 32 in the (M−1)-th row and in the M-th row), the selection of the scan lines 32 during the unit period U (the first write period W1) of the drive period SB starts. During the period of time when the preparation period SA and the drive period SB overlap each other, the selection of the scan lines 32 during the selection period HA and the selection of the scan lines 32 during the selection period HB are performed in an alternating way.

The drive circuit 40 sets the time length Δt to a variable value, according to the instruction supplied from the display-control circuit 142. Specifically, the time length Δt is set to a variable value, according to the response characteristic (the response speed) of the liquid crystal 66, in order for the display grayscale of the liquid crystal cell CL to actually reach the given grayscale G0 during a period running over the time period Δt after starting supplying the preparation potential that is in response to the given grayscale G0 during the selection period HA of the preparation period SA. Specifically, the time length Δt is set to such a short time period that the response speed of the liquid crystal 66 is fast. As described above, in a case where the time length of each of the display periods Pi is set to 8 milliseconds (about 1/120 second), for example, the time length of the preparation period SA and each of the time lengths of the first and second write period W1 and W2 of each of the unit periods U are set to 1.75 milliseconds, and time Δt is set to 1 milliseconds.

The glasses-control circuit 144 of the control circuit 14 in FIG. 1, is controlled by synchronizing the individual states (the open state/the closed state) of the right-eye and left-eye shutters 22 and 24 of the stereoscopic viewing glasses 20 with operation of the electro-optical panel 12. Specifically, the glasses-control circuit 144, as shown in FIG. 3, controls both of the right-eye and left-eye shutters 22 and 24, to be in the closed state during the preparation period SA of each of the display periods Pi. Furthermore, during the right-eye display period PR, the glasses-control circuit 144 enables the right-eye shutter 22 to be in the open state at the ending point of the preparation period SA and enables the left-eye shutter 24 to be in the closed state. Also, during the left-eye display period PL, the glasses-control circuit 144 enables the left-eye shutter 24 to be in the open state at the ending point of the preparation period SA, and enables the right-eye shutter 22 to be in the closed state.

Therefore, the right-eye image GR that is displayed on the pixel unit 30 during the drive period SB of the right-eye display period PR penetrates the right-eye shutter 22 and reaches the right eye of the viewer and is blocked in the left-eye shutter 24. On the other hand, the left-eye image GL that is displayed on the pixel unit 30 during the drive period SB of the left-eye display period PL penetrates the left-eye shutter 24 and reaches the left eye of the viewer and is blocked in the right-eye shutter 22. The viewer perceives stereoscopy in the display image by visually recognizing the right-eye image GR penetrating the right-eye shutter 22 with his right eye, and by visually recognizing the left-eye image GL penetrating the left-eye shutter 24 with his left eye.

In the first embodiment described above, during the preparation period SA of each of the display periods Pi, since the display grayscale of each of the pixels PIX is controlled to be the given grayscale G0 that is independent of the right-eye and left-eye images GR and GL, concurrent presence (crosstalk) of the right-eye and left-eye images GR and GL does not occur. That is, since the right-eye and left-eye images GR and GL are reliably separated from each other for the right eye and the left eye, respectively, the viewer can perceive clear stereoscopy.

As the configuration which controls each of the pixels PIX to be the given grayscale G0 before supplying the grayscale potential, for example, a configuration may be also considered which starts supplying of the grayscale potential to each of the pixels PIX after finishing the selection of all of the scan lines 32 during the preparation period SA (hereinafter referred to as "comparative example"). That is, in the comparison example, the preparation period SA and the drive period SB do not overlap along the time axis. In the first embodiment, since the supplying of the grayscale potential to each of the pixels PIX during the drive period SB starts before finishing the selection of the scan lines 32, during the preparation period SA of each of the display periods P, the time length of the drive period SB during the display period Pi may be made larger, compared with the comparison example. That is, the writing of the grayscale potential starts from an earlier point in time during the display period Pi, and thus the display grayscale of the pixels PIX in the M rows may be changed from the given grayscale G0 to the assigned grayscale of the display image Gi at an earlier point in time, compared with the comparison example. Therefore, brightness of the display image that the viewer visually recognizes may be improved, compared with the comparison example.

Furthermore, in the first embodiment, since the preparation potential that is in response to the given grayscale G0 is supplied to each of the pixels PIX two at a time, for example, the time length of the preparation period SA may be shortened, compared with the configuration in which the scan lines 32 are sequentially selected one after another during the preparation period SA. Therefore, an effect of improving the brightness of the display image that the viewer recognizes is particularly remarkable.

Furthermore, in the first embodiment, the scan lines 32 are selected two at a time during the first write period W1 of the unit period U1 of the drive period SB, and the grayscale potential is supplied to each of the pixels PIX. Therefore, for example, there is an advantage of shortening the time it takes the display grayscale of the pixels PIX in the M rows to be changed from the immediately preceding given grayscale G0 to the assigned grayscale of the image Gi, compared with the configuration in which the scan lines 32 are selected one after another and the grayscale potential is supplied to each of the pixels PIX during the unit period U1.

Furthermore, as described above, in the configuration in which the scan lines 32 are selected two at a time and the grayscale potential is supplied to each of the pixels PIX, the image, whose resolution in the y direction is half of resolution of an original image represented by the image signal, is displayed during the first write period W1 of each of the unit periods U. However, since every other scan line 32 is selected, and the grayscale potential is supplied to each of the pixels PIX during the immediately following second write period W2, the decrease in the resolution of the display image during the first write period W1 is difficult for the viewer to perceive. In particular, in the first embodiment, supply targets to which the grayscale potential is supplied during the first write period W1 are different during the unit period U1 and during unit period U2. For example, when the grayscale potential is supplied to each of the pixels PIX in the first set during the unit period U1, the grayscale potential is supplied to each of the pixels PIX in the second set which is at a distance of one row only from the first set during the unit period U2. Therefore, for example, an effect that the decrease in the resolution of the display image during the first write period W1 is difficult for the viewer to perceive is particularly remarkable, compared with the configuration in which the grayscale potential is supplied every first set during both of the unit periods U1 and U2.

However, in the configuration in which the time length Δt is set to a given value, for example, in a case where the response speed of the liquid crystal 66 is low, the display grayscale of each of the pixels PIX completely does not reach the given grayscale G0 at the time when the time length Δt elapses from the starting point of supplying the preparation potential, and thus the immediately preceding display image (crosstalk) is possible for the viewer to perceive. In the first embodiment, since the time length Δt is set to a variable value, the time length Δt may be properly set according to the response characteristic of the liquid crystal 66, in order for the display grayscale of each of the pixels PIX to reliably reach the given grayscale G0. Therefore, there is an advantage of reliably preventing the viewer from perceiving concurrent presence of the right-eye and left-eye images GR and GL and at the same ensuring the brightness of the display image.

Furthermore, even though the assigned grayscale is common, when the grayscale potential is set to a positive polarity and when the grayscale potential is set to a negative polarity, the applied voltages to the liquid crystal cells CL (the display grayscale of each of the pixels PIX) may differ. In a case where a polarity-reverse cycle of the applied voltage to the liquid crystal cell CL is long (for example, in a case of reversing the polarity during of each of the display periods Pi), there is a problem in that fluctuation in the display grayscale (that is, flickering), resulting from a difference in the polarity of the applied voltage, is easy for the viewer to perceive. In the first embodiment, since the polarity of the applied voltage to the liquid crystal cell CL is reversed in a short cycle such as during the unit period U, there is an advantage in that fluctuation in the display grayscale, resulting from a difference in the polarity of the applied voltage, is difficult for the viewer to perceive.

Figures 7, 8:
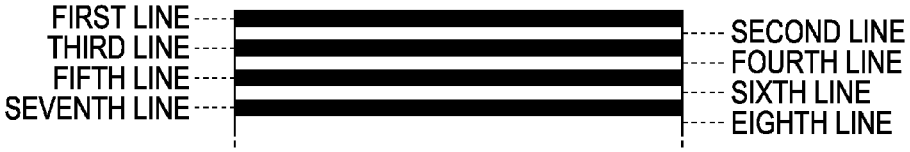
FIG. 7 is a schematic diagram that helps understand an effect of the first embodiment.
FIG. 8 is an explanatory view illustrating changes over time in applied voltage to a liquid crystal element of each pixel.

Next, referring to FIG. 7, voltage is described which is applied to the liquid crystal cell CL of each of the pixels PIX when the lowest grayscale (black) is displayed on each of the pixels PIX in the odd-numbered row and the highest grayscale (white) is displayed on each of the pixels PIX in the even-numbered row. The normally black mode is illustratively described below in which voltage is not applied to the liquid crystal cell CL of each of the pixels PIX which makes the lowest grayscale displayed (±0V) and ±5 V voltage is applied to the liquid crystal cell CL of each of the pixels PIX which makes the highest grayscale displayed.

FIG. 8 is an explanatory view illustrating changes over time in the voltage which is applied to the liquid crystal cell CL of each of the pixels PIX in the even-numbered row (the 2k-th row) and in the odd-numbered row (the (2k+1)-th row) during the drive period SB, under the conditions described above. Since the grayscale potential of positive polarity that is in response to the assigned grayscale (the lowest grayscale) in the odd-numbered row is supplied to each of the pixels PIX in the first set during the first write period W1 of the unit period U1, the applied voltage to the liquid crystal cells CL in the 2k-th row and in the (2k+1)-th row is set to 0V. Since the grayscale potential of positive polarity that is in response to the assigned grayscale (the highest grayscale) in the even-numbered row is supplied to each of the pixels PIX in the even-numbered row during the second write period W2 of the unit period U1, +5V voltage is applied to the liquid crystal cells CL in the 2k-th row, and the applied voltage to the liquid crystal cells CL in the (2k+1)-th row which are not selected is maintained at the immediately preceding voltage (0V).

Since the grayscale potential of negative polarity that is in response to the assigned grayscale (the highest grayscale) in the even-numbered row is supplied to each of the pixels PIX in the second set during the first write period W1 of the unit period U2, the applied voltage to the liquid crystal cells CL in the 2k-th row and in the (2k+1)-th row is set to −5V. Furthermore, since the grayscale potential of negative polarity that is in response to the assigned grayscale (the lowest grayscale) in the odd-numbered row is supplied to each of the pixels PIX in the odd-numbered row during the second write period W2 of the unit period U2, the applied voltage to the liquid crystal cells CL in the (2k+1)-th row is set to 0V, and the applied voltage to the liquid crystal cells CL in the 2k-th row which are not selected is maintained at the immediately preceding voltage (−5V).

As described above, the applied voltage to the liquid crystal cells CL in the 2k-th row is changed to 0V, +5V, −5V, and −5V in this order during the display period Pi, and the applied voltage to the liquid crystal cells CL in the (2k+1)-th row is changed to 0V, 0V, −5V, and 0V in this order during the display period Pi. That is, the length of time it takes the negative polarity voltage to be applied to the liquid crystal cells CL in any of the odd-numbered row and the even-numbered row tends to be longer. Therefore, in the configuration in which, during both of the right-eye and left-eye display periods PR and PL, the first drive is performed during the unit period U1 and the second drive is performed during the unit period U2, the applied voltage to the liquid crystal cell CL is biased to either of the positive polarity and the negative polarity, and thus characteristic deterioration in the liquid crystal cell CL, resulting from applying a DC component, may occur.

In the first embodiment, since the relationship between the unit period U1/the unit period U2 and the first drive/the second drive is reversed during the right-eye display period PR and during the left-eye display period PL, if the right-eye image GR and the left-eye image GL are similar in content, the polarity bias described above referring to FIG. 8, is offset during the right-eye display period PR and during the left-eye display period PL. Therefore, there is a considerable advantage of effectively controlling the characteristic deterioration in the liquid crystal cell CL, resulting from applying the DC component.

Second Embodiment

The second embodiment of the invention will be described below. In the embodiments described below, elements which are equivalent in operation and function to those in the first embodiment are given reference numerals that are referred to in the above description, and descriptions of these elements are accordingly omitted.

Figure 9:
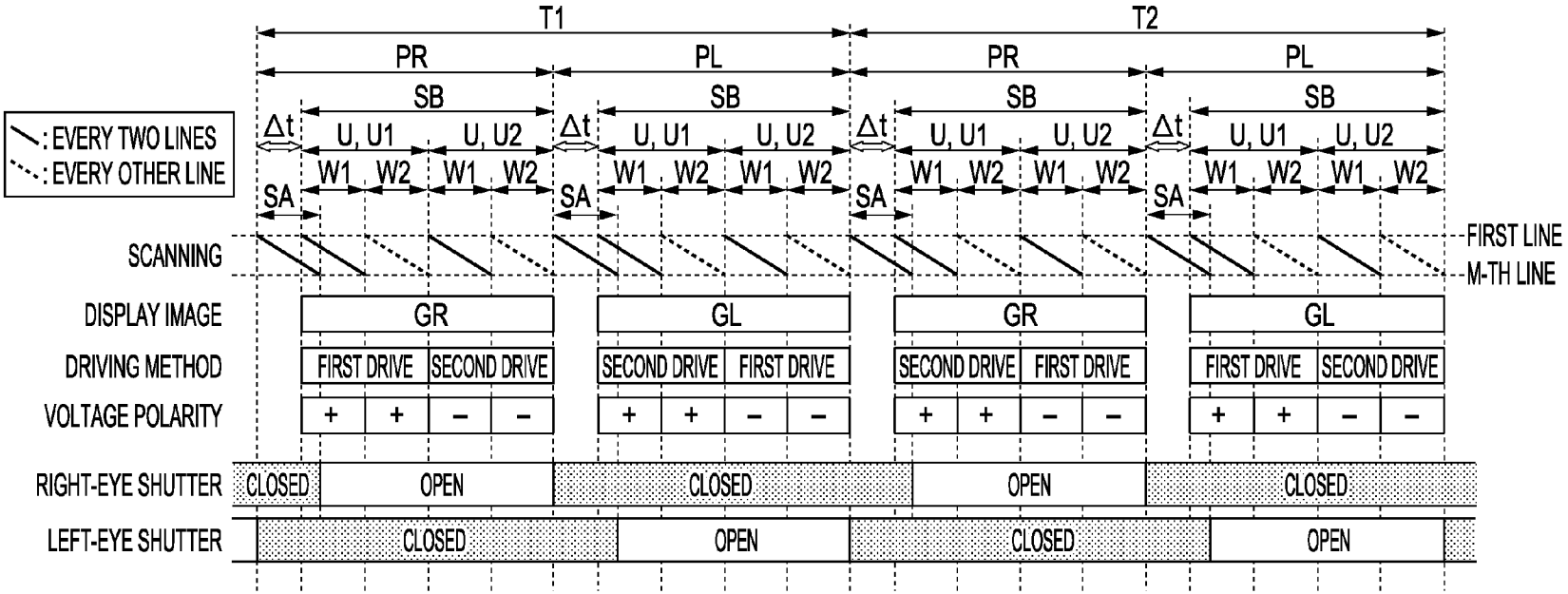
FIG. 9 is an explanatory view illustrating operation of a second embodiment.

FIG. 9 is an explanatory view illustrating operation of the second embodiment. As shown in FIG. 9, each of control periods T consisting of a right-eye display period PR and a left-eye display period PL that occur in an alternating way, is divided into a control period T1 and a control period T2. The control period T1 and the control period T2 are alternately arranged along the time axis.

As is apparent from FIG. 9, a configuration in which the relationship between a unit period U1/a unit period U2 and a first drive/a second drive is reversed during the right-eye display period PR and during the left-eye display period PL of the control period T, is the same as the configuration in the first embodiment. In the second embodiment, a drive circuit 40 performs the first drive or the second drive during each of the unit period U1, to reverse the relationship between the unit period U1/unit period U2 and the first drive/second drive during the right-eye display period PR of the control period T1 and during the right-eye display period PR of the control period T2, and reverse the relationship between the unit period U1/unit period U2 and the first drive/second drive during the left-eye display period PL of the control period T1 and during the left-eye display period PL of the control period T2.

That is, during the control period T1, the drive circuit 40 performs the first drive during the unit period U1 of the right-eye display period PR and performs the second drive during the unit period U2. Furthermore, the drive circuit 40 performs the second drive during the unit period U1 of the left-eye display period PL and performs the first drive during the unit period U2. On the other hand, during the control period T2, the drive circuit 40 performs the second drive during the unit period U1 of the right-eye display period PR and performs the first drive during the unit period U2. Furthermore, the drive circuit 40 performs the first drive during the unit period U1 of the left-eye display period PL and performs the second drive during the unit period U2.

The drive circuit 40 reverses the polarity of the applied voltage to the liquid crystal cell CL every unit period U as in the first embodiment. That is, the polarity of the applied voltage to the liquid crystal cell CL (the polarity of the grayscale potential) is set to the positive polarity during the unit period U1 of each of the display periods Pi (PR, PL), and is set to the negative polarity during the unit period U2, during any of the control period T1 and the control period T2. Therefore, it may be restated that, in the second embodiment, the relationship between the polarity of the applied voltage to the liquid crystal cell CL and the first drive/the second drive is reversed during the right-eye display period PR of the control period T1 and during the right-eye display period PR of the control period T2, and is reversed during the left-eye display period PL of the control period T1 and during the left-eye display period PL of the control period T2.

The second embodiment has the same effect as the first embodiment. Furthermore, in the second embodiment, since during the display period Pi the relationship between the unit period U1/the unit period U2 and the first drive/the second drive is reversed during the control period T1 and during the control period T2, the polarity bias, described above referring to FIG. 7, is offset during the control period T1 and during control period T2. Therefore, there is a considerable advantage of effectively controlling the characteristic deterioration in the liquid crystal cell CL, resulting from applying the DC component.

Third Embodiment

Figure 10:
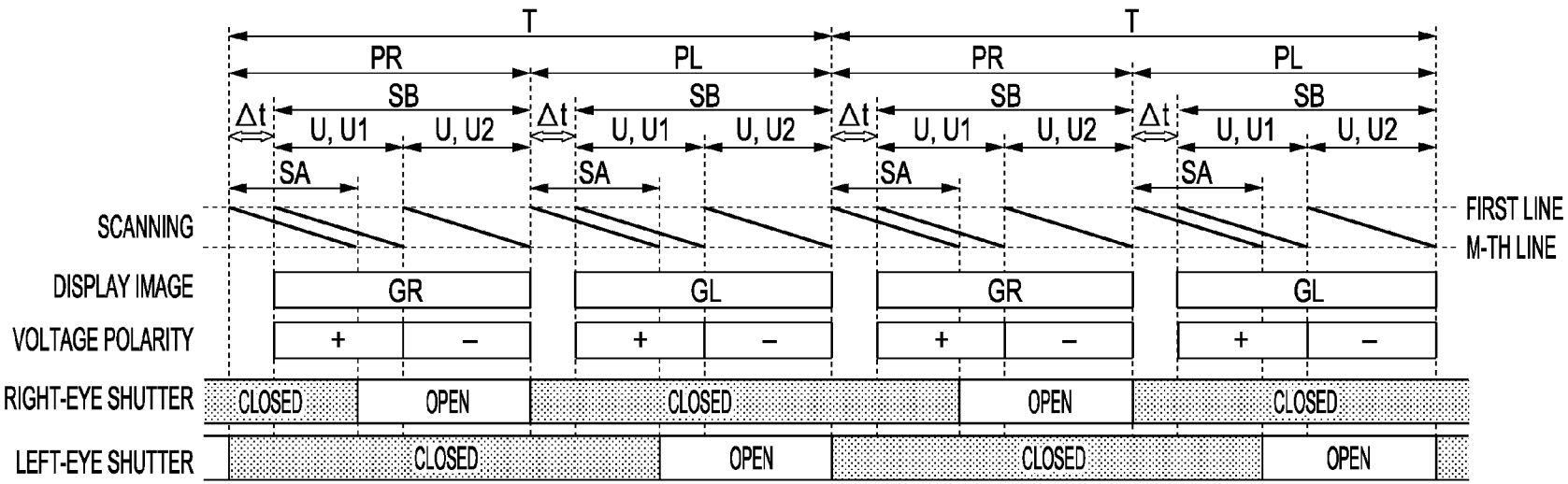
FIG. 10 is an explanatory view illustrating operation of a third embodiment.

FIG. 10 is an explanatory view illustrating operation of the third embodiment. As shown in FIG. 10, in the third embodiment, a drive period SB of each of display periods Pi is divided into a unit period U1 and a unit period U2. Each of the unit period U1 and the unit period U2 is configured by M selection periods HB. A scan line drive circuit 42 selects scan lines 32 one after another during selection period HB, and a signal line drive circuit 44 supplies to each of signal lines 34 a drive signal X [n] of grayscale potential that is in response to an assigned grayscale of each of pixels PIX corresponding to the scan line 32 in a selection state. A polarity of applied voltage to a liquid crystal cell CL is reversed every unit period U. Specifically, the polarity of the applied voltage to the liquid crystal cell CL is set to a positive polarity (+) during a unit period U1 of each of display periods Pi and is set to a negative polarity (−) in a unit period U2.

On the other hand, during a preparation period SA, preparation potential that is in response to a given grayscale G0 is supplied to each of the pixels PIX by a unit of one row. That is, the scan line drive circuit 42 selects the M scan lines 32 one after another every selection period HB of the preparation period SA, and the signal line drive circuit 44 supplies to each of the signal lines 34 the drive signal X [n] that is set to the preparation potential, every selection period HA. Therefore, concurrent presence of a right-eye image GR and a left-eye image GL (crosstalk) may be prevented as in the first embodiment.

Furthermore, the preparation period SA and the drive period SB partly overlap each other as in the first embodiment. Specifically, as shown in FIG. 10, before finishing the selection of the last scan line 32 (the scan lines in the M th line) during the preparation period SA, the supplying of the grayscale potential to each of the pixels PIX starts during the drive period SB. That is, the supplying of the grayscale potential to each of the pixels PIX may start from an earlier point in time during the display periods Pi, compared with the configuration in which the drive period SB starts after the preparation period SA elapses (a comparison example). Therefore, there is an advantage of improving brightness of a display image that the viewer visually recognizes, compared with the comparison example. That is, in the third embodiment as in the first embodiment, concurrent presence of the right-eye and left-eye images may be controlled to be imperceptible to the viewer, and the brightness of the display image may be improved.

Fourth Embodiment

Figure 11:
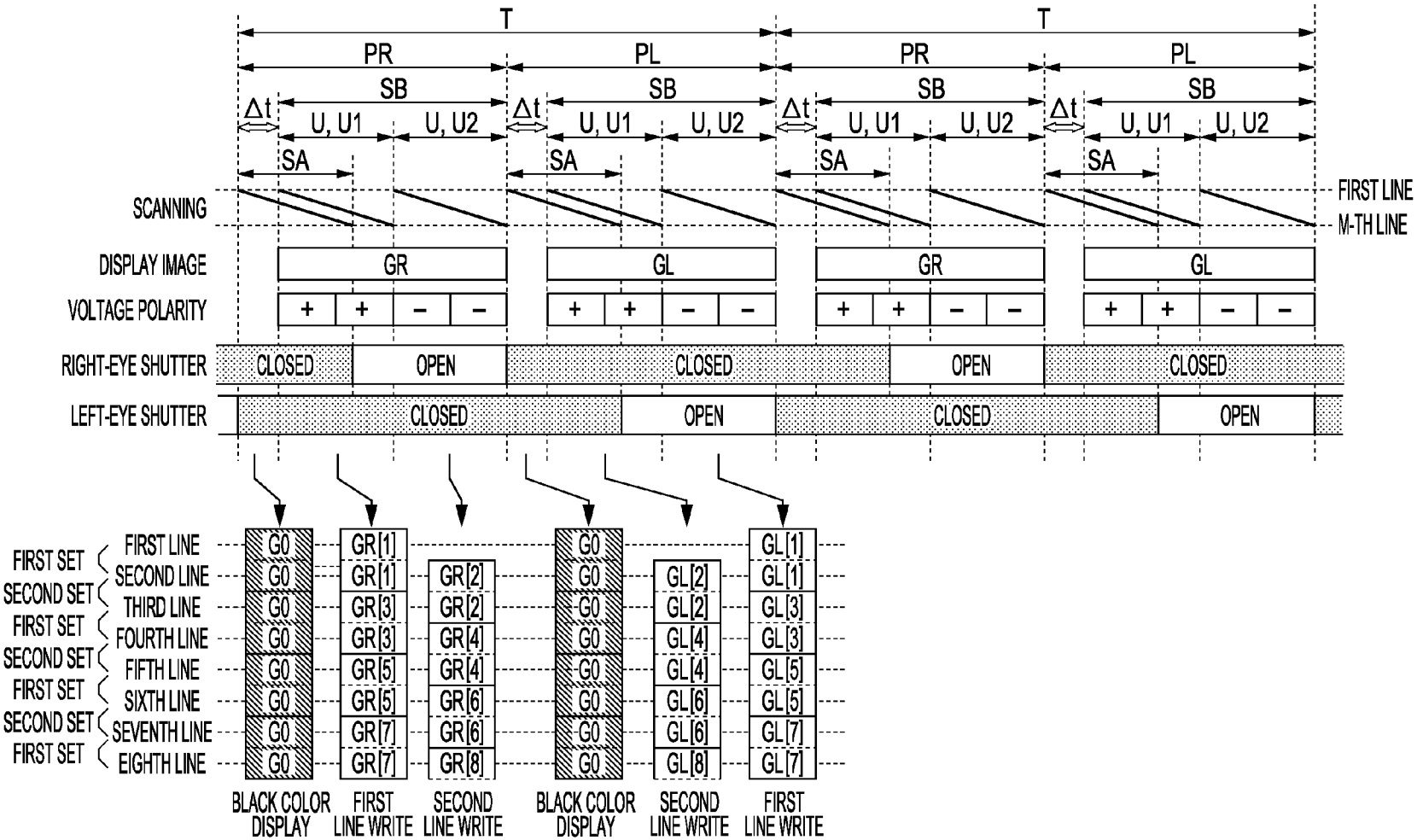
FIG. 11 is an explanatory view illustrating operation of a fourth embodiment.

FIG. 11 is an explanatory view illustrating operation of the fourth embodiment. As shown in FIG. 11, each of display periods Pi (PR, PL), as in the embodiments described above, is configured by a preparation period SA and a drive period SB that partly overlap each other. During the preparation period SA, a drive circuit 40, as in the first embodiment, sequentially selects M pixels PIX every first set (two scan lines 32 in the (2k−1)-th row and the 2k-th row) during the selection period HA, and supplies the preparation potential of a given grayscale G0 to each of the pixels PIX in the first set (two rows) in a selection state.

The drive period SB of each of the display periods Pi is divided into a unit period U1 and a unit period U2. The fourth embodiment has the same configuration in which a polarity of applied voltage to a liquid crystal cell CL of each of pixels PIX is reversed every unit period U as the first to three embodiments do. During each of the unit periods U of the drive period SB, the drive circuit 40 sequentially selects the M scan lines 32 every two or more scan lines 32 and supplies grayscale potential to each of the pixels PIX.

Specifically, during the unit period U1 of the drive period SB of the right-eye display period PR, the drive circuit 40 sequentially selects the M scan lines 32 every first set during each of the selection periods HB as it does during the first write period W1 at the time of performing the first drive shown in FIG. 5, and supplies the grayscale potential that is in response to an assigned grayscale GR [2k−1] in the (2k−1)-th row in the right-eye image GR to each of the pixels PIX in the first set (the (2k−1)-th row and the 2k-th row) in a selection state. Furthermore, during the unit period U2 of the drive period SB of the right-eye display period PR, the drive circuit 40 sequentially selects the M scan lines 32 every second unit during each of the selection periods HB as it does during the first write period W1 at the time of the second drive shown in FIG. 6, and supplies the grayscale potential that is in response to the assigned grayscale GR [2k] in the 2k-th row in the right-eye image GR to each of the pixels PIX in the second set (the 2k-th row and the (2k+1)-th row) in the selection state.

On the other hand, during the left-eye display period PL, a combination of the unit period U1/unit period U2 and the first set/the second set is reversed differently than during the right-eye display period PR. That is, during the unit period U1 of the drive period SB of the left-eye display period PL, the drive circuit 40 sequentially selects each of the second sets every selection period HB, and supplies the grayscale potential that is in response to the assigned grayscale GL[2k] in the 2k-th row in the left-eye image GL to each of the pixels PIX in the second set (the 2k-th row and the (2k+1)-th row) in the selection state. Furthermore, during the unit period U2 of the drive period SB of the left-eye display period PL, the drive circuit 40 sequentially selects each of the first sets every selection period HB, and supplies the grayscale potential that is in response to the assigned grayscale GL[2k−1] in the (2k−1)-th row in the left-eye image GL to each of the pixels PIX in the first set (the (2k−1)-th row and the 2k-th row) in the selection state.

Since the preparation period SA and the drive period SB partly overlap each other, the fourth embodiment has the same effect as the first embodiment. Furthermore, during each of the unit periods U1 and U2 of each of the display periods Pi, an image, of which the resolution in the y direction is half of resolution of an original image represented by an image signal, is displayed. However, the image, which is displayed every first set, in response to the assigned grayscale GR [2k−1] in the odd-number during the unit period U1 of the right-eye display period PR, is sequentially changed to the image that is in response to the assigned grayscale GR [2k] in the even-numbered row by a unit of the second set that is at a distance of one scan line only from the first set, during the immediately following U2. This is true for the left-eye display period PL. Therefore, there is an advantage in that a decrease in resolution of the display image during each of the unit periods U is difficult for the viewer to perceive.

Furthermore, in the fourth embodiment, the relationship between the unit period U1/the unit period U2 (a positive polarity/a negative polarity of applied voltage to a liquid crystal cell CL) and the first set/the second set is reversed during the right-eye display period PR and during the left-eye display period PL. That is, during the right-eye display period PR, the grayscale potential is supplied every first set during the unit period U1 (the positive polarity) and the grayscale potential is supplied every second set during the unit period U2 (the negative polarity). During the left-eye display period PL, the grayscale potential is supplied every second set during the unit period U1 (the positive polarity), and the grayscale potential is supplied every first set during the unit period U2 (the negative polarity). Therefore, a polarity difference in the applied voltage to the liquid crystal cell CL (residue of a DC component) is offset during the right-eye display period PR and during left-eye display period PL, and characteristic deterioration in the liquid crystal cell CL, resulting from applying the DC component, may be effectively controlled. During both of the right-eye display period PR and the left-eye display period PL, the grayscale potential may be supplied to each of the pixels PIX in the first set during the unit period U1, and the grayscale potential may be supplied to each of the pixels PIX in the second set during the unit period U2.

Variation Example

Each of the embodiments described above may come in a wide range of variations. Examples of specific variations are described below. Two or more examples randomly selected from the following description, when not in conflict with each other, may be combined in a suitable way.

(1) A method of supplying grayscale potential to each of pixels PIX during a drive period SB may be determined in various ways in the aspect of the invention. For example, during a unit period U1 of a drive period SB, scan lines 32 in one of the odd-numbered row and the even-number may be sequentially selected, and grayscale potential that is in response to an assigned grayscale may be provided to each of the pixels PIX. And during a unit period U2, the scan lines 32 in the other of the odd-numbered row and the even-number may be sequentially selected, and grayscale potential that is in response to the assigned grayscale may be provided to each of pixels PIX.

(2) In the embodiments described above, at the time of performing a first drive, the grayscale potential that is in response to the assigned grayscale Gi[2k−1] in the odd-number (the (2k−1)-th row) row is supplied to each of the pixels PIX in the first set during a first write period W1, and the grayscale potential that is in response to the assigned grayscale Gi[2k] in the even-number (the 2k-th row) is supplied to each of the pixels PIX in the even-numbered row during a second write period W2, and at the time of performing a second drive, the grayscale potential that is in response to the assigned grayscale Gi[2k] in the even-number (the 2k-th row) row is supplied to each of the pixels PIX in the second set during the first write period W1, and the grayscale potential that is in response to the assigned grayscale Gi[2k−1] in the odd-number (the (2k−1)-th row) row is supplied to each of the pixels PIX in the old-number row during the second write period W2. However, each of the pixels PIX (in the odd-numbered row/in even-numbered row) to which the grayscale potential is supplied during the second write period W2, and the assigned grayscale G (in the odd-numbered row/in the even-numbered row) which is reflected in the grayscale potential during each of the first write period W1 and the second write period W2 are not limited to the above example. For example, at the time of performing the first drive, the grayscale potential that is in response to the assigned grayscale Gi[2k] in the even-number (the 2k-th row) row is supplied to each of the pixels PIX in the first set during the first write period W1, and the grayscale potential that is in response to the assigned grayscale in the odd-number (the (2k−1)-th row) is supplied to each of the pixels PIX in the odd-numbered row during the second write period W2, and at the time of performing the second drive, the grayscale potential that is in response to the assigned grayscale Gi[2k−1] in the odd-number (the (2k−1)-th row) row is supplied to each of the pixels PIX in the second set during the first write period W1, and the grayscale potential that is in response to the assigned grayscale Gi[2k] in the even-number (the 2k-th row) is supplied to each of the pixels PIX in the even-numbered row during the second write period W2. That is, in a case where the M scan lines 32 are divided into first scan lines 32 and second scan lines 32 which are alternately arranged, the first drive includes a job of supplying the grayscale potential, which is in response to the assigned grayscale of each of the pixels PIX corresponding to the first scan line 32, to each of the pixels PIX in the first set during the first write period W1 and supplying the grayscale potential, which is in response to the assigned grayscale of each of the pixels PIX corresponding to the second scan line 32, to each of the pixels PIX during the second write period W2, and the second drive includes a job of supplying the grayscale potential, which is in response to the assigned grayscale of each of the pixels PIX corresponding to the second scan line 32, to each of the pixels PIX in the second set during the first write period W1 and supplying the grayscale potential, which is in response to the assigned grayscale of each of the pixels PIX corresponding to the first scan line 32, to each of the pixels PIX during the second write period W2. The odd-number and even-number of the first scan line 32 and the second scan line 32 (odd-numbered row/even-numbered row) may be determined in various ways.

Furthermore, in the embodiments described above, the (2k−1)-th row and the 2k-th row are defined as the first set, and the 2k-th row and the (2k+1) row is defined as the second set. A method of dividing the M scan lines 32 may be changed in a suitable way. For example, the 2k-th row and the (2k+1)-th row are defined as a first set, and the (2k−1)-th row and the 2k row may be defined as the second set. Therefore, the grayscale potential, which is in response to the assigned grayscale Gi[2k] in the even-numbered row (the 2k-th row) during the first write period W1 of the unit period U1, may be supplied to each of the pixels PIX in the first set, and the grayscale potential, which is in response to the assigned grayscale Gi[2k+1] in the odd-number (the (2k+1)-th row) row during the second write period W2, may be supplied to each of the pixels PIX in the odd-numbered row. And the grayscale potential, which is in response to the assigned grayscale Gi[2k−1] in the odd-numbered row (the (2k−1)-th row) during the first write period W1 of the unit period U2, may be supplied to each of the pixels PIX in the second set, and the grayscale potential, which is in response to the assigned grayscale Gi[2k] in the even-number (the 2k-th row) row during the second write period W2, may be supplied to each of the pixels PIX in the even-numbered row.

(3) In each of the embodiments described above, a case is proposed for illustrative purposes, in which the grayscale potential is not supplied to each of the pixels PIX in the first row during the first write period W1 at the time of performing the second drive. However, the grayscale potential that is in response to the assigned grayscale Gi[1] in the corresponding row, or the grayscale potential that is in response to the given grayscale (for example, black grayscale and half tone) may be supplied to each of the pixels PIX in the first row.

(4) The points in time when the right-eye shutter 22 and the left-eye shutter 24 opens and closes are not limited to the above-described example. For example, in each of the embodiments described above, at the ending point of the preparation period SA of the right-eye display period PR, the right-eye shutter 22 is changed from a closed state to an open state, but the right-eye shutter 22 may be changed from the closed state to the open state in a suitable way. Specifically, in the configuration in which the right-eye shutter 22 is changed to the open state before the ending point of the preparation period SA of the right-eye display period PR, a section of the immediately preceding left-eye image GL (a section that has yet to be changed to the given grayscale G0 during the preparation period SA) during the preparation period SA may be perceptible to the viewer, but brightness of the display image may be improved. On the other hand, in the configuration in which the right-eye shutter 22 is changed to the open state at some point in time after the ending point of the preparation period SA of the right-eye display period PR, the brightness of the display image decreases, but the immediately preceding left-eye image GL may be reliably prevented from being perceptible to the viewer during the right-eye display period PR. Likewise, the point in time when the right-eye shutter 22 is changed from the open state to the closed state may be set to a point in time before or after the ending point of the right-eye display period PR. For example, the right-eye shutter 22 may be in the open state, until a point in time when the drive period SB starts (that is, a point in time when a time length Δt elapses from the ending point of the right-eye display period PR) during the left-eye display period PL immediately following the right-eye display period PR. Furthermore, The period of time when the crosstalk in the display image is difficult for the viewer to perceive depends upon the relationship between the response characteristic of the right-eye shutter 22 and the left-eye shutter 24 and the response characteristic of an electro-optical panel 12 (the liquid crystal cell CL), as well. Therefore, the period of time when the right-eye shutter 22 opens and closes is determined based on a variety of factors including a priority of preventing the crosstalk from being perceptible to the viewer and a priority of ensuring the brightness of the display image (a balance between the two priorities), and the relationship between the response characteristic of the stereoscopic viewing glasses 20 and the response characteristic of the electro-optical panel 12. The right-eye shutter 22 is described above. However, this is true for the period of time when the left-eye shutter 24 opens and closes.

As is apparent from the above description, the period of time when the right-eye shutter 22 opens and closes is broadly defined as a period of time including the period of time when includes at least a section of the drive period SB of the right-eye display period PR (regardless of whether or not a section of the immediately preceding preparation period SA is included). Likewise, the period of time when the left-eye shutter 24 is in the open state is broadly defined as a period of time including the period of time when includes at least a section of the drive period SB of the left-eye display period PL (regardless of whether or not a section of the immediately preceding preparation period SA is included). Furthermore, the period of time when both of the right-eye shutter 22 and the left-eye shutter 24 remain in the closed state is broadly defined as a period of time including at least a section of the preparation period SA during each of the display periods Pi (PR, PL) (regardless of whether or not a section of the immediately following drive period SB is included).

(5) In the first and second embodiments, the number of the scan lines 32 making up the first set and the second set is not limited to two. That is, the first set and the second set are broadly defined as sets, each of which is determined by grouping the M scan lines 32 by the Q scan lines 32 adjacent to each other (Q is a positive integer equal to or greater than 2) in a different combination. When the first set and the second sets are defined as sets of Q scan lines 32, each of the unit period U1 and the unit period U2 of the drive period SB is configured by Q write periods W1 to WQ. The first drive is broadly defined as an operation by which to sequentially select each of the first sets every selection period HB during the first write periods W1 of the unit period U, and supply the grayscale potential, which is in response to the assigned grayscale of each of the pixels PIX corresponding to the first scan line 32 in the first set in a selection state, to each of the signal lines 34, and supply to each of the signal lines 34 the grayscale potential, which is in response to the assigned grayscale of each of the pixels PIX corresponding to the q-th scan line 32 among the Q scan lines 32 in the first set, during each of the write periods W2 to WQ of the unit period U. Likewise, the second drive is broadly defined as an operation by which to sequentially select each of the second sets every selection period HB during the first write periods W1 of the unit period U, and supply the grayscale potential, which is in response to the assigned grayscale of each of the pixels PIX corresponding to the first scan line 32 in the second set in the selection state, to each of the signal lines 34 and supply to each of the signal lines 34 the grayscale potential, which is in response to the assigned grayscale of each of the pixels PIX corresponding to the q-th scan line 32 among the Q scan lines 32 in the second set, during each of the write periods W2 to WQ of the unit period U.

(6) The number of the scan lines 32 that are selected at the same time during each of the selection period HA of the preparation period SA is not limited to two. For example, in the first and second embodiments, the configuration may be employed in which the scan lines 32 are selected one after another every selection period HA of the preparation period SA, or the configuration may be employed in which the scan lines 32 are selected by three or more of scan lines 32 during every selection period HA of the preparation period SA. In terms of simplifying the operation and configuration of the scan line drive circuit 42, the number of the scan lines 32 which are selected at the same time during the preparation period SA may be equal to the number of the scan lines 32 (the number of the first sets and the number of the second sets) which are selected at the same time during the first write period W1 of the drive period SB, and the preparation period SA and the first write period W1 and the second write period W2 may be set to an equal time length.

(7) The first embodiment has, as an example, the configuration in which the relationship between the unit period U1/the unit period U2 (the positive polarity/the negative polarity of the grayscale potential) and the first drive/second drive is reversed during the right-eye display period PR and during left-eye display period PL (hereinafter referred to as "configuration A". The second embodiment has, as an example, the configuration in which the relationship between the unit period U1/the unit period U2 and the first drive/the second drive is reversed during the control period T1 and under the control period T2 (hereinafter referred to as "configuration B") is added to the first embodiment. However, the configuration A is not a requirement for the configuration B, and the configuration B may be employed independently of the configuration A. That is, the configuration in which the relationship between the unit period U1/the unit period U2 and the first drive/the second drive is made common during the right-eye display period PR and the left-eye display period PL of the control period T, and is reversed during the control period T1 and during the control period T2 may be employed as well. For example, during the right-eye display period PR and the left-eye display period PL of the control period T1, the first drive is performed during the unit period U1 and the second drive is performed during the unit period U2. During the right-eye display period PR and the left-eye display period PL of the control period T2, the second drive is performed during the unit period U1, and the first drive is performed during the unit period U2.

(8) Given pre-charge potential may be supplied to each of the signal lines 34 before the grayscale potential is supplied to each of the pixels PIX during each of the selection periods HA of the drive period SB. The preparation potential supplied to each of the pixels PIX during each of the selection period HA of the preparation period SA (the potential changing the immediately preceding display image to the given grayscale G0) and the pre-charge potential supplied to the signal line 34 during each of the selection period HB of the drive period SB (the potential initializing each of the signal lines 34 to the given potential before supplying the grayscale potential) may be different in the supply period to each of the pixels PIX and the potential value because the preparation potential and the pre-charge potential may serve different purposes.

(9) The electro-optical element is not limited to the liquid crystal cell CL. For example, an electrophoresis element may be used as an electro-optical element. That is, electric potential optical elements are broadly defined as a display element which changes in optical characteristics (for example, transmission) depending on electric operation (for example, application of electric current).

Application Example

Figure 12:
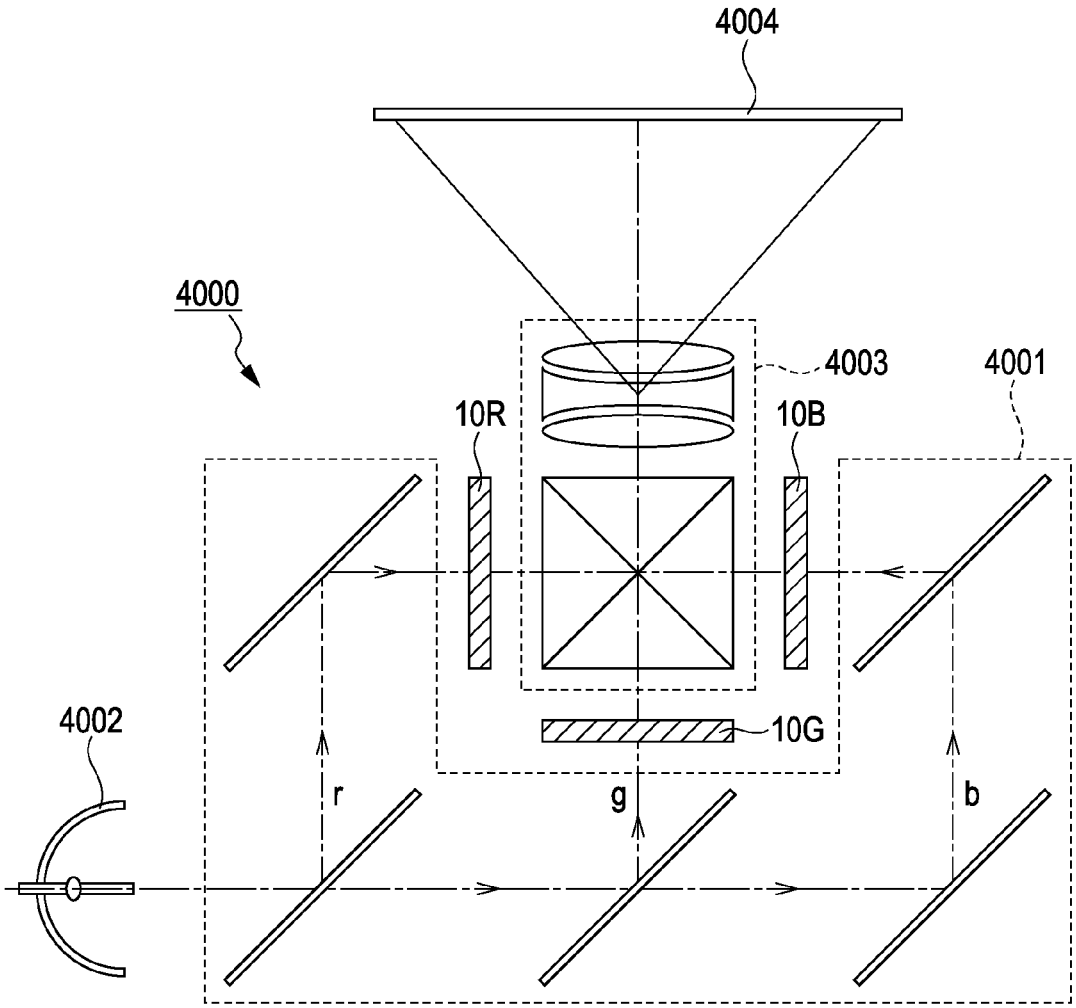
FIG. 12 is a perspective view illustrating an electronic device (projection-type display device).
Figure 13:
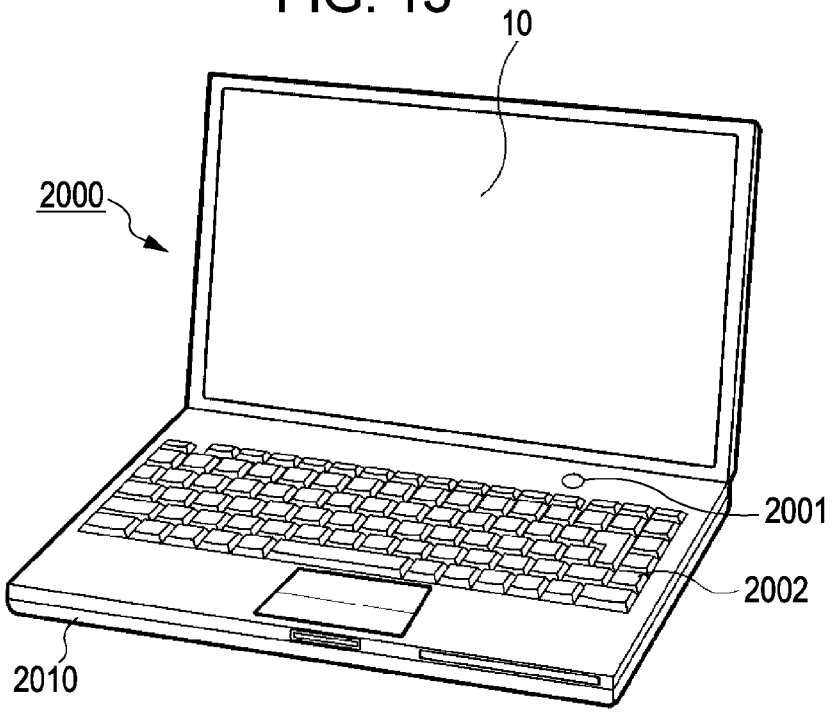
FIG. 13 is a perspective view illustrating an electronic device (personal computer).
Figure 14:
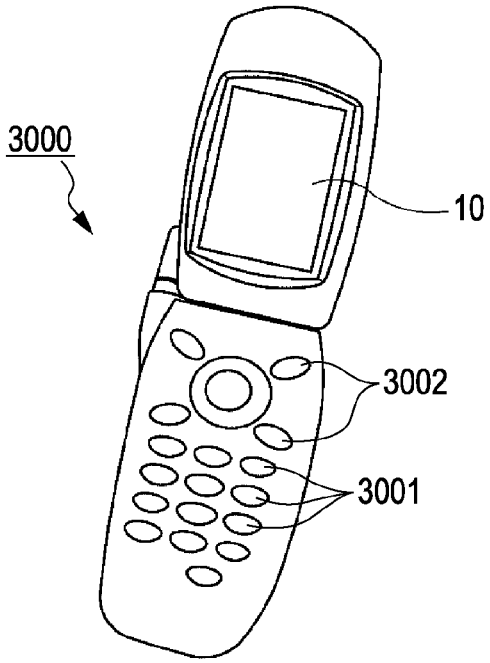
FIG. 14 is a perspective view illustrating an electronic device (portable telephone).
Figure 15:
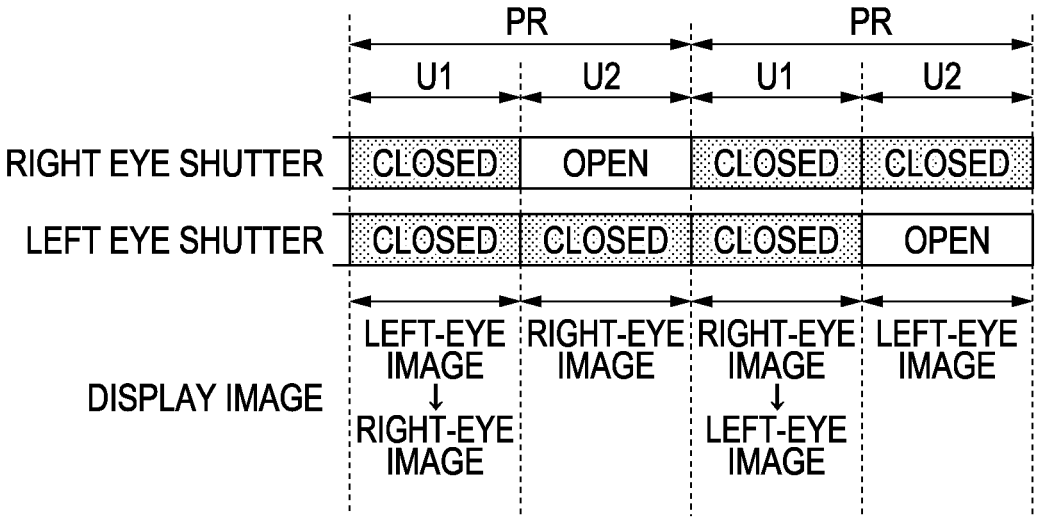
FIG. 15 is an explanatory view illustrating stereoscopic view operation in the conventional art.

The electro-optical device 10, which is taken as an example in the embodiments described above, may be used in a variety of electronic devices. In FIGS. 12 to 14, specific examples of the electronic device which uses the electro-optical device 10 are shown.

FIG. 12 is a schematic diagram of projection-type display device (a three-panel projector) 4000 which is equipped with the electro-optical device 10. The projection-type display device 4000 is equipped with three of the electro-optical devices 10 (10R, 10G, 10B) corresponding to the display colors (red, green, blue). An illumination optical system 4001 supplies a red component r to the electro-optical device 10R, a green component g to the electro-optical device 10G, and a blue component b to the electro-optical device 10B, among outgoing beams from an illumination device (a light source) 4002. Each electro-optical device 10 serves as an optical modulation device (a light valve) modulating each monochromatic light supplied from the illumination optical system 4001, in response to the display image. A projection optical system 4003 synthesizes the outgoing beam emitted from each of the electro-optical devices 10 and projects a synthesized beam to a projection surface 4004. The viewer visually recognizes a stereoscopic image projected on the projection surface 4004 with stereoscopic viewing glasses 20 (not shown in FIG. 12).

FIG. 13 is a perspective view illustrating a portable personal computer equipped with the electro-optical device 10. The personal computer 2000 includes the electro-optical device 10 displaying a variety of images, and a body unit 2010 including a power switch 2001 and a keyboard 2002.

FIG. 14 is a perspective view illustrating a portable telephone equipped with the electro-optical device 10. The portable telephone 3000 includes a plurality of operation buttons 3001 and scroll buttons 3002, and the electro-optical device 10 displaying a variety of images. The image displayed on the electro-optical device 10 is scrolled up or down by operating the scroll buttons 3002.

In addition to the devices shown in FIGS. 12 to 14, the electro-optical device according to the aspect of the invention includes devices such as a PDA (Personal Digital Assistant), a digital still camera, a television, a video camera, a car navigation device, a display device (panel) for a car, an electronic organizer, an electronic paper, a calculator, a word processor, a workstation, a television telephone, a POS terminal, a printer, a scanner, a copier, a video player, and a device with a touch panel.

This application claims priority to Japan Patent Application No. 2011-202805 filed Sep. 16, 2011, the entire disclosures of which are hereby incorporated by reference in their entireties.

What is claimed is:

1. An electro-optical device that alternately displays right-eye images during a first display period and left-eye images during a second display period, comprising:

a plurality of pixels arranged corresponding to interconnections between a plurality of scan lines and a plurality of signal lines; and a drive circuit sequentially selecting one or more scan lines of the plurality of scan lines during a preparation period of each of the first and second display periods and supplying a preparation potential to one or more pixels of the plurality of pixels corresponding to the one or more scan lines in a selection state, and sequentially selecting one or more scan lines of the plurality of scan lines during a drive period of each of the first and second display periods, the drive period starting before selecting a last scan line of the plurality of scan lines during the preparation period of each of the first and second display periods, and supplying grayscale potential that is in response to an assigned grayscale corresponding to each of one or more pixels of the plurality of pixels corresponding to the one or more scan lines in the selection state.

2. The electro-optical device according to claim 1, wherein the drive circuit sequentially selects the scan lines several at a time during a first unit period among a plurality of unit periods of the drive period of each of the display periods and supplies the grayscale potential that is in response to the assigned grayscale of each of the pixels corresponding to any of the plurality of scan lines in the selection state to each of the pixels corresponding to the plurality of scan lines in the selection state.

3. The electro-optical device according to claim 2, wherein the plurality of scan lines includes first scan lines and second scan lines which are alternately arranged, and wherein the drive circuit capable of performing a first drive of sequentially selecting first sets of scan lines that are determined by dividing the plurality of scan lines by two adjacent scan lines at a time and supplying the grayscale potential that is in response to the assigned grayscale of each of the pixels corresponding to the first scan line among the first sets of the scan lines in the selection state to each of signal lines during a first write period, and sequentially selecting each of the second scan lines and supplying the grayscale potential that is in response to the assigned grayscale of each of the pixels corresponding to the second scan lines in the selection state to each of the signal lines during a second write period after the end of the first write period, and capable of performing a second drive of sequentially selecting second sets of scan lines that are determined by dividing the plurality of scan lines by two adjacent scan lines at a time in a different combination from the combination used when determining the first sets and supplying the grayscale potential that is in response to the assigned grayscale of each of the pixels corresponding to the second scan line among the second sets of scanning lines in the selection state to each signal line during the first write period and sequentially selecting each of the first scan lines and supplying the grayscale potential that is in response to the assigned grayscale of each of the pixels corresponding to the first scan lines in the selection state to each of the signal lines during the second write period, performs the first drive during a first unit period of the drive period of the display period of the right-eye image and performs the second drive during a second unit period after the first unit period ends during the corresponding drive period, and performs the second drive during the first unit period of the drive period of the display period of the left-eye image and performs the first drive during the second unit period of the corresponding drive period.

4. The electro-optical device according to claim 3, wherein the drive circuit sets the polarity of the applied voltage to each of the pixels to a first polarity during the first and second write periods of the first unit period of the drive period of each of the display periods, and sets the polarity of the applied voltage to each of the pixels to a second polarity, which is the reverse of the first polarity, during the first and second write periods of the second unit period of the drive period of each of the display periods.

5. The electro-optical device according to claim 3, wherein the drive circuit performs the first drive during the first unit period of the drive period of the display period of the right-eye image, and performs the second drive during the second unit period of the corresponding drive period, and performs the second drive during the first unit period of the drive period of the display period of the left-eye image and performs the first drive during the second unit period of the corresponding drive period, during the first control period among a plurality of control periods each of which includes the display period of the right-eye image and the display period of the left-eye image that appear in an alternating way, and performs the second drive during the first unit period of the drive period of the display period of the right-eye image and performs the first drive during the second unit period of the corresponding drive unit and performs the first drive during the first unit period of the drive period of the display period of the left-eye image and performs the second drive during the second unit period of the corresponding drive period, during the second control period different from the first control period, among the plurality of control periods.

6. The electro-optical device according to claim 2, wherein the drive circuit capable of performing a first drive of sequentially selecting the first sets of scan lines that are determined by dividing the plurality of scan lines by Q (Q is a positive integer equal to or greater than 2) scan lines adjacent to each other and supplying the grayscale potential that is in response to the assigned grayscale of each of the pixels corresponding to the first scan line in the first set in the selection state to each of the signal lines during the first write period and supplying the grayscale potential that is in response to the assigned grayscale of each of the pixels corresponding to the q-th scan line in each of the first sets to each of the signal lines during the q-th write period (q=2 to Q) after the first write period ends, and capable of performing a second drive of sequentially selecting the second sets of scan lines that are determined by dividing the plurality of scan lines Q scan lines adjacent to each other at a time in a different combination from the combination used when determining the first sets and supplying the grayscale potential that is in response to the assigned grayscale of each of the pixels corresponding to the first scan line in the second set in the selection state to each signal line during the first write period, and supplying the grayscale potential that is in response to the assigned grayscale of each of the pixels corresponding to the q-th scan line in each of the second sets to each of the signal lines, during the q-th write period, performs the first drive during a first unit period of the drive period of the display period of the right-eye image and performs the second drive during a second unit period after the first unit period ends during the corresponding drive period, and performs the second drive during the first unit period of the drive period of the display period of the left-eye image and performs the first drive during the second unit period of the corresponding drive period.

7. The electro-optical device according to claim 2, wherein the plurality of scan lines includes first scan lines and second scan lines which are alternately arranged, and wherein the drive circuit sequentially selects the first sets of scan lines that are determined by dividing the plurality of scan lines by two adjacent scan lines at a time and supplies the grayscale potential that is in response to the assigned grayscale of each of the pixels corresponding to the first scan line in the first sets in the selection state to each of the signal lines, during one of the first unit period and the second unit period of the drive period of each of the display periods, and sequentially selects the second sets of scan lines that are determined by dividing the plurality of scan lines by two adjacent scan lines at a time in a different combination from the combination used when determining the first sets and supplies the grayscale potential that is in response to the assigned grayscale of each of the pixels corresponding to the second scan lines in the second sets in the selection state to each of the signal lines, during the other of the first unit period and the second unit period.

8. The electro-optical device according to claim 7, wherein the drive circuit sequentially selects the first sets of scan lines and supplies the grayscale potential to each of the pixels during the first unit period of each of the display periods of the right-eye image, and sequentially selects the second sets of scan lines and supplies the grayscale potential to each of the pixels during the second unit period of the corresponding display period, and sequentially selects the second sets of scan lines and supplies the grayscale potential to each of the pixels during the first unit period of each of the display periods of the left-eye image, and sequentially selects the first sets of scan lines and supplies the grayscale potential to each of the pixels during the second unit period of the corresponding display period.

9. The electro-optical device according to claim 1, wherein the drive circuit selects the plurality of scan lines several scan lines at a time during the preparation period.

10. The electro-optical device according to claim 1, further comprising:

stereoscopic viewing glasses that display the right-eye and left-eye images that are able to be viewed stereoscopically, and that include a right-eye shutter and a left-eye shutter; and a glasses-control circuit controlling both of the right-eye and left-eye shutters to be in a closed state during the period including at least a section of the preparation period of each of the display periods, controlling the right-eye shutter to be in an open state and controlling the left-eye shutter to be in the closed state during a period including at least a section of the drive period of the display period of the right-eye image, and controlling the left-eye shutter to be in an open state and controlling the right-eye shutter to be in the closed state during a period including at least a section of the drive period of the display period of the left-eye image.

11. An electronic device comprising the electro-optical device according to claim 1.

* * * * *